US009989899B2

(12) United States Patent
Ebihara et al.

(10) Patent No.: US 9,989,899 B2
(45) Date of Patent: Jun. 5, 2018

(54) IMAGE FORMING APPARATUS AND MANAGEMENT SYSTEM

(71) Applicant: CANON KABUSHIKI KAISHA, Tokyo (JP)

(72) Inventors: Shun-ichi Ebihara, Suntou-gun (JP); Tomonori Shida, Mishima (JP); Michio Sugano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/334,643

(22) Filed: Oct. 26, 2016

(65) Prior Publication Data

US 2017/0123352 A1 May 4, 2017

(30) Foreign Application Priority Data

Oct. 29, 2015 (JP) ..... 2015-213021
Oct. 29, 2015 (JP) ..... 2015-213022

(51) Int. Cl.
*G03G 15/00* (2006.01)
*G03G 15/20* (2006.01)

(52) U.S. Cl.
CPC ..... *G03G 15/2028* (2013.01); *G03G 15/5029* (2013.01); *G03G 15/6588* (2013.01)

(58) Field of Classification Search
CPC ..... G03G 15/2028; G03G 15/5029; G03G 15/6588; G03G 15/6591; G03G 15/6594
See application file for complete search history.

(56) References Cited

U.S. PATENT DOCUMENTS 8,843,004 B2 9/2014 Satoh et al.
2004/0240893 A1* 12/2004 Sato ..... G03G 15/5075 399/8
2007/0059058 A1* 3/2007 Ito ..... G03G 15/6594 399/323
2011/0268482 A1* 11/2011 Akamatsu ..... G03G 15/2025 399/327

FOREIGN PATENT DOCUMENTS

JP 2000-131978 A 5/2000
JP 2000-284549 A 10/2000
JP 2004-352478 A 12/2004
JP 2009-186684 A 8/2009
JP 4887114 B2 2/2012
JP 2012-059044 A 3/2012
JP 2012-141484 A 7/2012
JP 2012-226138 A 11/2012
JP 2014-178344 A 9/2014
JP 2014-238887 A 12/2014

OTHER PUBLICATIONS

Unpublished, copending U.S. Appl. No. 15/336,140, filed Oct. 27, 2016.

* cited by examiner

*Primary Examiner* — Sophia S Chen
(74) *Attorney, Agent, or Firm* — Fitzpatrick, Cella, Harper & Scinto

(57) ABSTRACT

An image forming apparatus includes a feeding unit for feeding a recording material, and a calculating unit for calculating a degree of deterioration of the feeding unit, while making correction depending on stiffness of the recording material and a content of a filler contained in the recording material.

30 Claims, 12 Drawing Sheets

IMAGE FORMING APPARATUS AND MANAGEMENT SYSTEM

FIELD OF THE INVENTION AND RELATED ART

The present invention relates to an electrophotographic image forming apparatus such as a copying machine, a printer and a facsimile machine, and relates to a management system of the image forming apparatus.

Conventionally, the electrophotographic image forming apparatus is applied to the copying machine, the printer, the facsimile machine, or the like. In these image forming apparatuses, a user uses information on species of a recording material set by the user, and a thickness sensor is provided (for example, Japanese Laid-Open Patent Application (JP-A) 2000-284549) or a stiffness detection is made (for example, JP-A 2012-226138), so that a characteristic (property) of the recording material is acquired. The acquired characteristic of the recording material is used for determining an image forming condition, so that images with a predetermined quality can be formed on various recording materials.

In the electrophotographic image forming apparatus, consumables such as a toner supplying container and/or members including a photosensitive drum, a developing device, a fixing device, a transfer device and the like are mounted. Of these members, each of members having a lifetime shorter than a guaranteed operation time (lifetime) of a main assembly of the image forming apparatus is assembled into a unit. When these units reach ends of the lifetimes thereof, these units are replaced with fresh (new) units on a unit basis. As a result, these units meet continuous use of the image forming apparatus. However, in recent years, needs such that a management cost of the image forming apparatus is intended to be reduced increase. Also as regards the above-described units, it has been desired that the lifetimes of the units are detected or predicted with accuracy and then is notified and the management cost is reduced by lowering a frequency of replacement (exchange) of the units through use of the units for a long term until the units reach the ends of the lifetimes thereof.

In order to satisfy the lifetimes of the replaceable units with accuracy, there is a need to estimate a degree of a lowering in performance of each of the units (hereinafter referred to as a degree of deterioration) with accuracy. As a method of estimating the degree of deterioration of a rotation feeding means, for such a unit, relating to feeding of the recording material with accuracy, a method of monitoring the number of sheets of the recording material fed or the number of rotations (turns) of the rotation feeding means is used in general and is easy. In this method, at timing when the number of fed sheets of the recording material exceeds a predetermined number (of sheets) or at timing when the number of rotations of the rotation feeding means exceeds a predetermined number of rotations, a message of prewarning of the lifetime of the unit or a message that the lifetime of the unit reaches its end is displayed on a main assembly of the image forming apparatus or in a personal computer (PC) side where the PC is connected with the image forming apparatus. As the method of estimating the degree of deterioration of the unit with accuracy, the following methods are proposed. For example, a method in which depending on a difference in mode of the image forming apparatus (e.g., a difference in species between plain paper and an OHT sheet) or depending on a difference in number of sheets of continuously fed recording materials, a calculation result is multiplied by a weighting efficiency has been proposed (e.g., JP-A 2000-131978). Further, a method in which estimation accuracy is improved depending on smoothness of a recording material detected by an image forming apparatus or depending on a basis weight of the recording material inputted by a user has been proposed (e.g., JP-A 2014-178344).

The estimation accuracy can be improved to some extent by taking the smoothness or the basis weight of the recording material into consideration when the degree of deterioration of the unit is estimated depending on the recording material used by the user. However, according to study by the present inventors, it turned out that the difference in degree of deterioration of the rotation feeding means generates in some cases although the image forming apparatus is operated under the same condition using the recording materials having the same smoothness and the same basis weight.

SUMMARY OF THE INVENTION

The present invention has been accomplished in view of these circumstances. A principal object of the present invention is to provide an image forming apparatus and a management system which are capable of accurately estimating a degree of a lowering in performance of a feeding means depending on a recording material to be fed.

According to an aspect of the present invention, there is provided an image forming apparatus comprising: a feeding unit for feeding a recording material; and a calculating unit for calculating a degree of deterioration of the feeding unit, while making correction depending on stiffness of the recording material and a content of a filler contained in the recording material.

According another aspect of the present invention, there is provided a surface comprising: a plurality of image forming apparatuses; and a management apparatus connected with the image forming apparatuses via a network circuit, wherein each of the image forming apparatuses includes, a plurality of placing portions where a recording material is placed, a feeding unit for feeding the recording material, and a calculating unit for calculating a degree of deterioration of the feeding unit, wherein the management apparatus includes, a setting unit capable of making batch setting, for each of the placing portions, of values of stiffness of recording materials placed on the placing portions of the image forming apparatuses and contents of fillers contained in the recording materials, and wherein the calculating unit calculates the degree of deterioration on the basis of the value of the stiffness of the recording material and the content of the filler which are set by the setting unit and then calculates a lifetime of the feeding unit on the basis of the calculated degree of deterioration.

Further features of the present invention will become apparent from the following description of exemplary embodiments with reference to the attached drawings.

DESCRIPTION OF THE EMBODIMENTS

In the following, Embodiments of the present invention will be specifically described with reference to the drawings. An operation time guaranteed for a main assembly of an image forming apparatus or respective units is hereinafter referred to as a lifetime, and a degree of a lowering in performance of each of the units is hereinafter referred to as a degree of deterioration.

Embodiment 1

Figure 1:
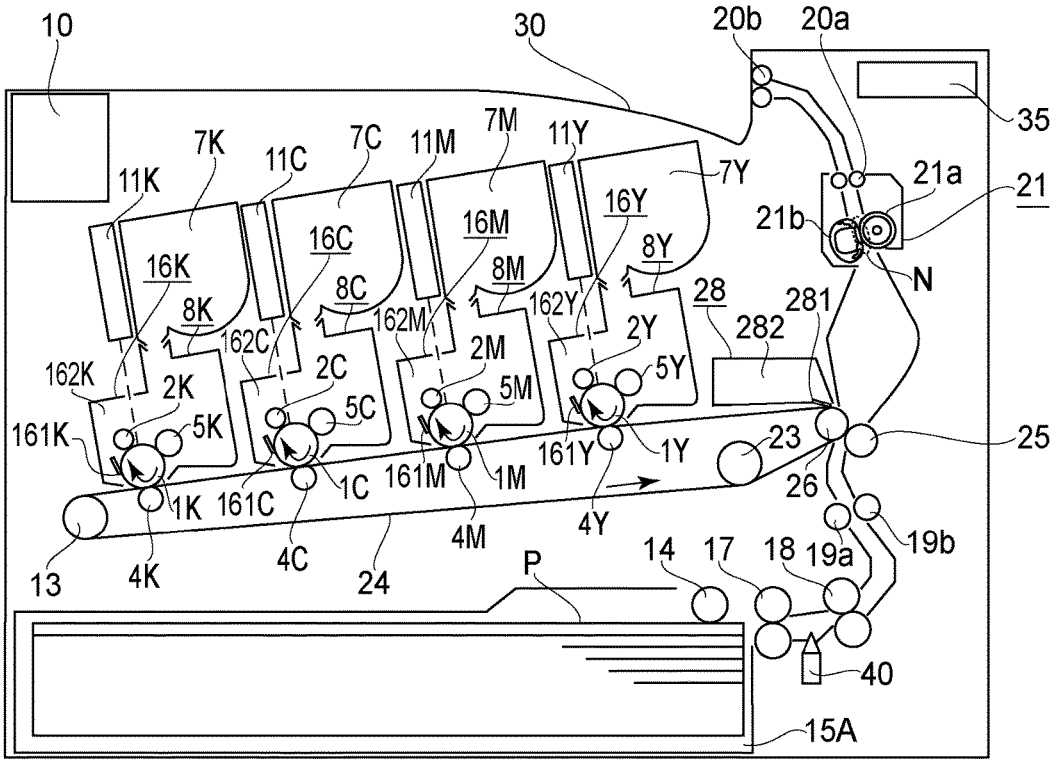
FIG. 1 is a schematic sectional view of an image forming apparatus in Embodiment 1.

In Embodiment 1, calculation of a lifetime of a rotation feeding means constituting an image forming apparatus is made depending on stiffness of a recording material detected by a stiffness detecting means provided in a feeding path. Here, the stiffness of the recording material is a degree indicating a resistance to flection and bending of paper and is also referred to as flexibility of paper or rigidity of paper. FIG. 1 is a schematic sectional view of the image forming apparatus in this embodiment. In this embodiment, as an example of the image forming apparatus, a color image forming apparatus using an intermediary transfer belt is used, but an image forming apparatus having another constitution may also be used.

[Image Forming Apparatus]

The image forming apparatus in this embodiment is a printer of a 4 drum full color type. An image forming portion is constituted by stations of colors of yellow (Y), magenta (M), cyan (C) and black (K) (stations 7Y, 7M, 7C, and 7K, respectively), in which photosensitive drums 1Y, 1M, 1C and 1K are provided, respectively, as image bearing members. Incidentally, the suffixes Y, M, C and K for representing the colors will be omitted hereinafter except for a necessary case. The image forming portion includes a charging roller 2 as a charging means, a scanner portion 11, a developing device as a developing means, a toner container as a toner supplying means, a drum cleaner 16, an intermediary transfer belt 24 as a rotatable member, and a secondary transfer roller 25. Further, the image forming portion includes a driving roller 26 functioning as an opposing roller to the secondary transfer roller 25 while driving the intermediary transfer belt 24, a stretching roller 13, an auxiliary roller 23, a primary transfer roller 4, and a fixing portion 21 as a fixing means. The image forming portion further includes a control calculating portion 10 as a calculating means for controlling an operating the above described means. The photosensitive drum 1 is constituted by applying an organic photoconductive layer onto an outer peripheral surface of an aluminum cylinder, and a driving force of an unshown driving motor is transmitted to the photosensitive drum 1, so that the photosensitive drum 1 is rotated. The driving motor rotates the photosensitive drum 1 in an arrow direction (clockwise direction) in FIG. 1 depending on an image forming operation.

When the control calculating portion 10 receives an image signal, a recording material P is fed from a sheet feeding cassette 15A, which is a placing portion where sheets of the recording material P are placed, into the image forming apparatus by a pick-up roller 14 and feeding rollers 17 and 18. Then, the fed recording material P is once sandwiched (nipped) between roller-shaped synchronization rotatable members for achieving synchronization between an image forming operation described later and the feeding of the recording material P, i.e., a registration roller pair 19*a* and 19*b*, and is kept at rest and on stand-by.

On the other hand, the control calculating portion 10 controls the scanner portion 11, so that an electrostatic latent image depending on the received image signal is formed by the scanner portion 11 on the surface of the photosensitive drum 1 electrically charged to a certain potential by the charging roller 2. The developing device 8 is a means for visualizing the electrostatic latent image on the photosensitive drum 1 and effects development for each of colors of Y, M, C and K of the stations. The developing device 8 includes a developing roller 5 to which a developing voltage for visualizing the electrostatic latent image is applied. In this way, the electrostatic latent image formed on the surface of the photosensitive drum 1 is developed into a single-color toner image by the developing device 8.

The intermediary transfer belt 24 contacts the photosensitive drum 1 during color image formation and rotates, in synchronism with rotation of the photosensitive drum 1, in an arrow direction (counterclockwise direction) in FIG. 1. The single-color toner images into which the electrostatic latent images are developed are successively transferred superposedly onto the intermediary transfer belt 24 by a primary-transfer voltage applied to the primary transfer rollers 4, so that a multi-color toner image is formed on the intermediary transfer belt 24. A toner remaining on each of the photosensitive drums 1 without being transferred onto the intermediary transfer belt 24 is collected by the drum cleaner 16 in contact with the photosensitive drum 1. The drum cleaner 16 includes a cleaning blade 161 and a toner collecting container 162.

The multi-color toner image formed on the intermediary transfer belt 24 is fed to a secondary transfer nip formed by the intermediary transfer belt 24 and the secondary transfer roller 25. The feeding of the recording material P kept on the stand-by in a state in which the recording material P is sandwiched between the conveying rollers 19*a* and 19*b* is resumed in synchronism with timing of the feeding of the toner images on the intermediary transfer belt 24 to the secondary transfer nip. The recording material P is fed to the secondary transfer nip by the conveying rollers 19*a* and 19*b* while achieving the synchronization with the feeding of the multi-color toner image on the intermediary transfer belt 24. Then, the multi-color toner image on the intermediary transfer belt 24 is transferred altogether onto the recording material P fed to the secondary transfer nip by a secondary transfer voltage applied to the secondary transfer roller 25.

The fixing portion 21 is roughly constituted by a pressing roller 21*a* which has an elastic layer and which is rotatable and by a rotatable heating member 21*b* which is press-contacted to the pressing roller 21*a* to form a fixing nip N and which includes a heater or the like which a heating means for heating the recording material P at the fixing nip N formed between itself and the pressing roller 21*a*.

[Fixing Portion]

Figure 2:
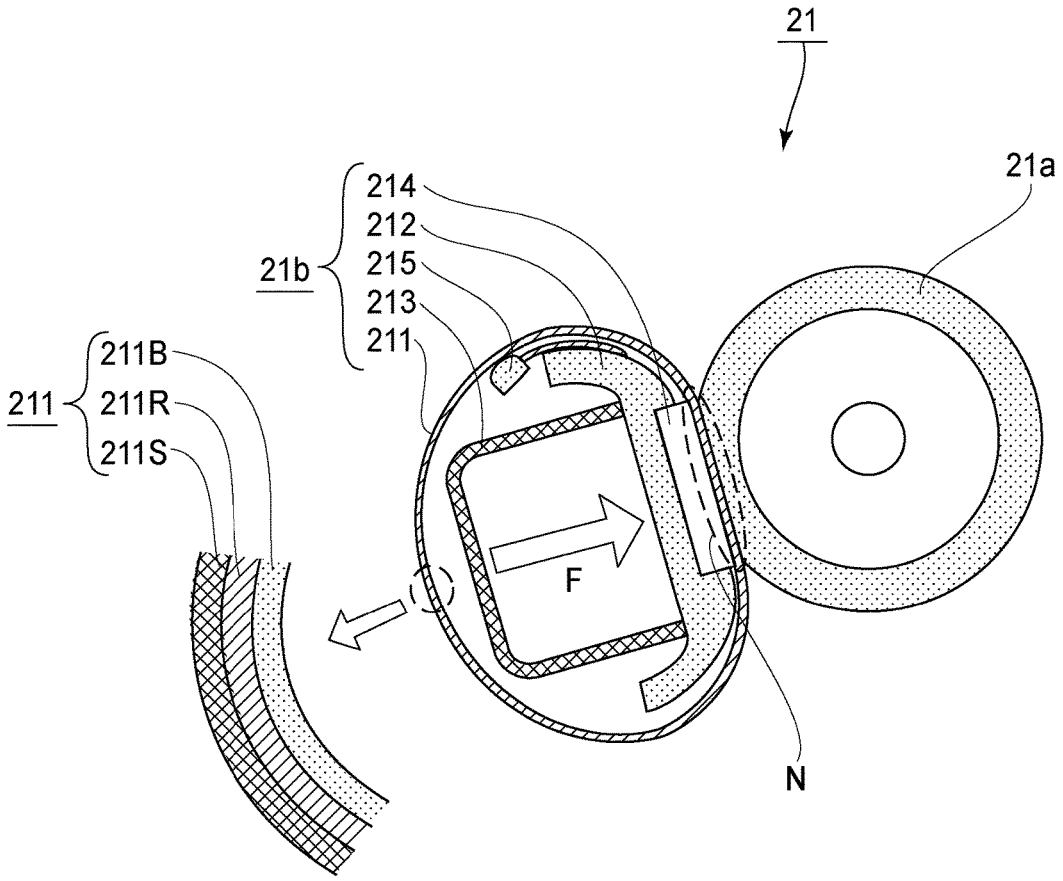
FIG. 2 is a schematic sectional view of a fixing portion in Embodiment 1.

FIG. 2 is a schematic structural view of the fixing portion 21. A heat-resistant cylindrical heating film 211 constituting the rotatable heating member 21*b* is loosely engaged around an outer periphery of a supporting holder 212 for holding the heating film 211 in a cylindrical shape and a metal-made fixing stay 213 for holding (supporting) the supporting holder 212. A plate-shaped heat generating member 214 is supported by the supporting holder 212 with respect to a longitudinal direction, and is pressed toward the pressing roller 21*a* via the heating film 211 by an unshown pressing means with a pressing force F, so that the fixing nip N is formed. The heating film 211 sandwiched between the pressing roller 21*a* and the plate-shaped heat generating member 214 is rotated around the supporting holder 212 and the fixing stay 213 relative to the pressing roller 21*a*. A temperature sensor 215 as a temperature detecting means contacts an inner surface of the heating film 211 and detects an inner surface temperature of the heating film 211. On the basis of the detected temperature, the control calculating portion 10 effects control so that the temperature of the heating film 211 is a predetermined temperature. The heating film 211 in this embodiment is prepared by successively forming a 300 μm-thick elastic layer 211R and a 25 μm-thick parting layer 211S in a named order on a 35 μm-thick film 211B. The film 211B includes a stainless material layer as a base layer. The elastic layer 211R is formed with a heat-conductive silicone rubber, and the parting layer is formed of a PFA material.

The recording material P on which the multi-color toner image is carried is not only fed by the pressing roller 21*a* but also subjected to application of heat and pressure at the fixing nip N, so that an unfixed multi-color toner image is fixed on the surface of the measurement result P. Referring again to FIG. 1, the recording material P on which the toner image is fixed is discharged onto a sheet discharge tray 30 by discharging rollers 20*a* and 20*b*, so that the image forming operation is ended. A belt cleaner 28 removes the toner remaining on the intermediary transfer belt 24 after the toner image is transferred onto the recording material by a cleaner blade 281, and the collected toner is stored in a cleaner container 282.

The above-described series of steps of the image forming operation is controlled by the control calculating portion 10. The control calculating portion 10 is connected with a control panel 35 or an unshown host computer, and controls the image forming apparatus depending on a command inputted through the control panel 35 or the unshown host computer. Further, the control calculating portion 10 also functions as a notifying means for notifying the user of states of the image forming apparatus and respective units by an alert sound and message display and as a calculating means for calculating a lifetime of a rotation feeding means of the image forming apparatus as described later. Further, the control calculating portion 10 also functions as a storing means for storing various parameters necessary to calculate the lifetime of the rotation calculating means.

[Calculating Method of Lifetime]

A method in which the degree of deterioration of the fixing portion 21 is predicted and calculated and on the basis of the calculated value, the lifetime of the fixing portion 21 is calculated will be described. Specifically, as a value acquired by prediction calculation of the degree of deterioration, an abrasion amount of the parting layer 211S of the heating film 211 which is a rotatable means is calculated and is corrected depending on stiffness of the recording material P. In the image forming apparatus used in this embodiment, the control calculating portion 10 uses $0.84\times10^{-4}$ μm/page as a standard value of the abrasion amount of the parting layer 211S by the feeding of the recording material P, and integrates and holds the abrasion amount every feeding of one recording material P.

Further, in an environment in which the image forming apparatus is actually used, when an abrasion amount per unit rotation (turn) of the heating film 211 is used as a basis compared with the case of the abrasion amount per unit page, accuracy of the prediction calculation is improved in some cases. Therefore, in this embodiment, the actually number of rotations (turns) of the heating film 211 is also measured and the abrasion amount is calculated and integrated using $0.17\times10^{-5}$ μm as a standard value of the abrasion amount per rotation, and the thus integrated abrasion amount is held. Then, lifetime calculation in which a degree that the integrated abrasion amount approaches a predetermined lifetime value of the fixing portion 21 is represented by a percentage is made. As described above, an initial value of a thickness of the parting layer 211S used in this embodiment is 25 μm. However, when abrasion (wearing) of the parting layer 211S progresses and a thickness of the parting layer 211S becomes excessively thin, there is a liability that a minute crack generates in the parting layer 211S and an effect of a parting performance is not sufficiently achieved and thus an image quality lowers. Accordingly, in this embodiment, the lifetime value of the integrated abrasion amount of the parting layer 211S is 23 μm, and the lifetime calculation is made by a formula (1) below.

In the formula (1), a remaining lifetime of the parting layer 211S is acquired. Here, the lifetime value refers to an integrated value of the abrasion amount of the parting layer 211S, and in this embodiment, when the integrated value of the abrasion amount of the parting layer 211S is 23 μm, the fixing portion 21 is regarded as reaching the end of its lifetime. In other words, when the thickness of the parting layer 211S is 2 μm (=25 μm−23 μm), the fixing portion 21 is regarded as reaching the end of the lifetime thereof. The time when the integrated value of the abrasion amount of the parting layer 211S is 23 μm is timing of exchanging the fixing portion 21.

$$\text{Remaining lifetime (\%)}=(1-(\text{integrated abrasion amount } (\mu m)/23))\times100 \quad (1)$$

A calculation result of the remaining lifetime by the formula (1) is displayed on the control panel 35 and is notified to the user.

Figure 3:
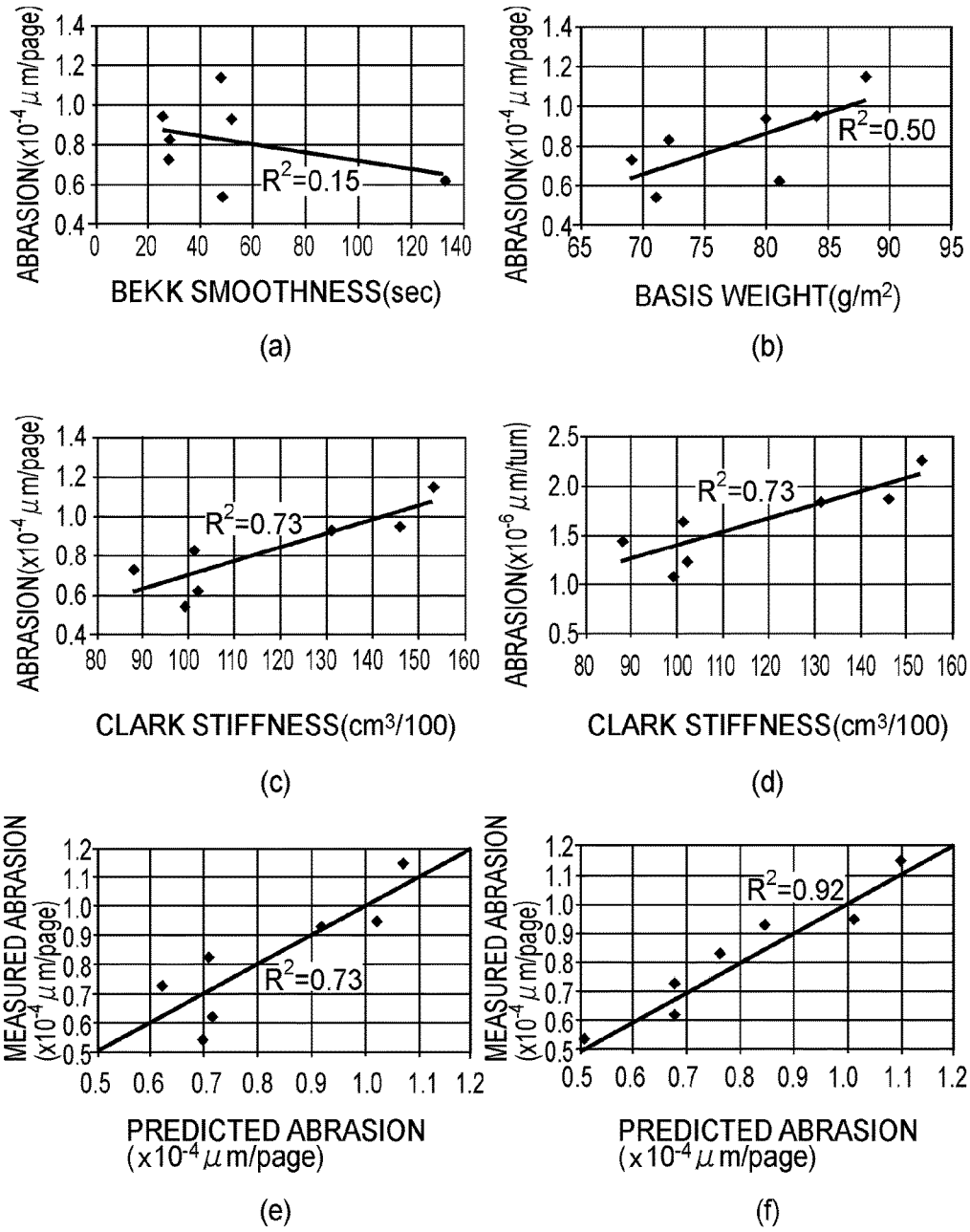
In FIG. 3, (a) to (f) are graphs each showing a relationship between an abrasion amount and a physical value of a recording material in Embodiment 1.

Incidentally, it is known that the abrasion amount of the parting layer 211S varies depending on a species of the recording material to be fed. In general, it would be considered that the while achieving the synchronization with the feeding of the multi-color toner image on the intermediary transfer belt 24 is smaller with an increasing surface smoothness of the recording material and with a decreasing basis weight. However, according to study by the present inventors, it was confirmed that a difference in abrasion amount of the parting layer 211S generates although recording materials which have similar values of the smoothness and the basis weight and different species are subjected to image formation under the same condition. In FIG. 3, (a) shows a result of conversion of the abrasion amount of the parting layer 211S measured when a test of an image forming operation by the image forming apparatus by using a plurality of recording materials different in smoothness, into an abrasion amount per page. In (a) of FIG. 3, the abscissa is the smoothness (Bekk smoothness) (sec) as measured by the Bekk method, and the ordinate is the abrasion amount per page ($\times 10^{-4}$ μm/page). The smoothness refers to a degree of smoothness of a (paper) surface of the recording material and is represented by a time (sec) in which the air in a predetermined amount passes through a gap at an uneven surface of the recording material (paper), and shows that the recording material is smoother with an increasing numerical value.

Similarly, (b) of FIG. 3 shows a result of a plot of the result of the same test relative to the basis weight. In (b) of FIG. 3, the abscissa is the basis weight (g/m$^2$) and the ordinate is the abrasion amount per page ($\times 10^{-4}$ μm/page). It can be said that either of the above-described results are those along a general view as a rough tendency. That is, in (a) of FIG. 3, the abrasion amount of the parting layer 211S is smaller with a decreasing degree of unevenness of the paper surface of the recording material (i.e., with a higher smoothness). In (b) of FIG. 3, the abrasion amount of the parting layer 211S is smaller with a smaller basis weight. However, a correlation efficiency $R^2$ in (a) of FIG. 3 is about 0.15, and a correlation efficiency $R^2$ in (b) of FIG. 3 is about 0.50, so that it can be said there is further room for improvement in accuracy of prediction calculation of the abrasion amount of the parting layer 211S.

When further study on these results is made, it turned out that the stiffness of the recording material and the abrasion amount of the parting layer 211S show a strong correlation and a correlation efficiency $R^2$ is 0.73. Results thereof are shown in (c) and (d) of FIG. 3. As a measuring method of the stiffness of the recording material in the above study, the Clark stiffness tester method according to JIS P 8143 is employed. As another method correlated with the Clark stiffness, for example, the Gurley method according to Japan TAPPI No. 40, the Taber stiffness tester method according to JIS P 8125, or a simple method according to TAPPI UM409 or the like is used. Even when these methods having correlation with the Clark stiffness are used for measuring the stiffness, it would be considered that a similar correlation with the abrasion amount of the parting layer 211S can be obtained.

In (c) and (d) of FIG. 3, the abscissa is the stiffness (Clark stiffness) (cm$^2$/100) of the recording material as measured by the Clark stiffness tester method. In (c) of FIG. 3, the ordinate is the abrasion amount per page ($\times 10^{-4}$ μm/page) of the parting layer 211S, and in (d) of FIG. 3, the ordinate is the abrasion amount per unit rotation ($\times 10^{-6}$ μm/turn (rotation)) of the parting layer 211S. In either case, with decreasing stiffness of the recording material, the abrasion amount of the parting layer 211S becomes smaller.

In view of the above-described results of the studies, in this embodiment, as shown in FIG. 1, a distance measuring sensor 40 for measuring a self-weight flection amount of the recording material P is provided as a detecting means for detecting the stiffness, between the sheet feeding rollers 17 and 18. The stiffness of the recording material P is obtained using a principle of the TAPPI UM409 measuring method bon the basis of the self-weight flection amount of the recording material P obtained on the basis of a detection result of the distance measuring sensor 40. Then, depending on the obtained stiffness of the recording material P, correction of the above-described standard value of the abrasion amount of the parting layer 211S is made.

Figure 4:
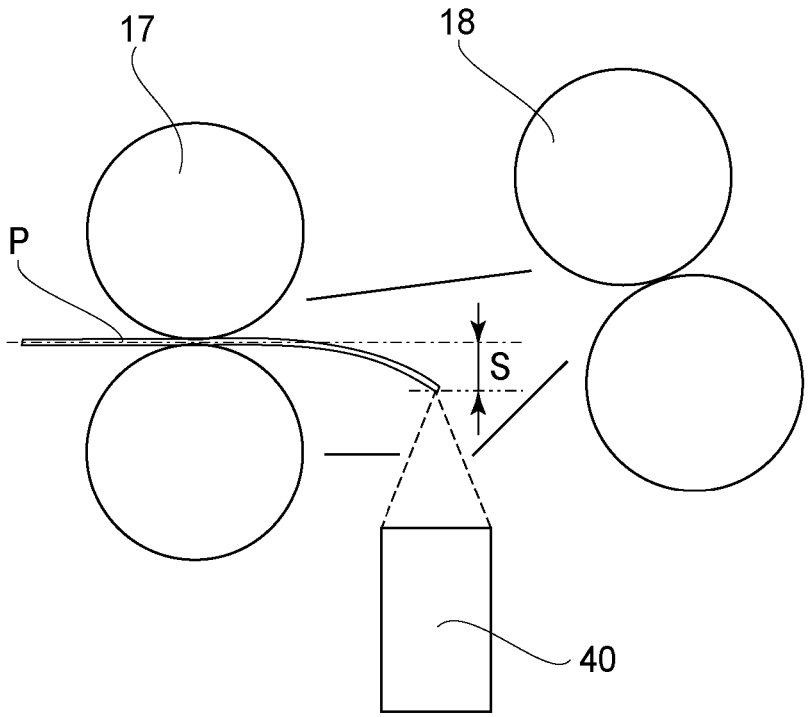
FIG. 4 is a schematic view for illustrating a recording material stiffness discriminating method in Embodiment 1.

FIG. 4 is a schematic view showing a principal part of the distance measuring sensor 40 and the neighborhood thereof. As shown in FIG. 4, when the recording material P is fed from the sheet feeding cassette 15A and a leading end thereof passes through the nip of the sheet feeding roller (pair) 17, the leading end of the recording material P is flexed below the nip of the sheet feeding roller 17 by the self-weight of the recording material P. A difference between a distance, which is a known value, from the distance measuring sensor 40 to a height of the nip of the sheet feeding roller 17 indicated by a chain line and a distance from the distance measuring sensor 40 to the leading end of the recording material P indicated by a chain double-dashed line is a self-weight flection amount S. Depending on the self-weight flection amount S obtained on the basis of the distances detected by the distance measuring sensor 40, the control calculation portion 10 determines a correction efficiency P (S) from 0.5 to 1.6 obtained by an experiment or the like in advance.

Specifically, the control calculating portion 10 determines the correction efficiency P(S) from 0.5 to 1.6 depending on the self-weight flection amount S shown in FIG. 4. Then, the control calculation portion 10 multiplies the standard value ($0.84\times 10^{-4}$ μm) per page of the recording material P of the abrasion amount of the parting layer 211S by the determined correction efficiency P(S) and then integrates the multiplied value every page. The thus-integrated abrasion amount (μm) is represented by the following formula (2).

$$\text{Integrated abrasion amount } (\mu m) = \Sigma(\text{standard value} \times P(S)) \quad (2)$$

The integrated abrasion amount of the formula (2) is measured by the integration method on a page number basis but may also be measured by the integration method on a rotation (turn) number basis. In this case, the integrated abrasion amount can be similarly obtained by setting the abrasion amount standard value per rotation at $0.17\times 10^{-5}$ μm. The integrated abrasion amount may only be required to be obtained by using at least one of the integration method on the page number basis and the integration method on the rotation number basis, and may also be obtained by using both of these methods.

In the case where the self-weight flection amount is large, the correction efficiency P(S) is 0.5 time, and in the case where the self-weight flection amount is small, the correction efficiency P(S) is 1.6 times. Further, as regards the recording material having the self-weight flection amount therebetween, the correction efficiency P(S) is stepwisely set and the abrasion amount per page is calculated, so that the integrated abrasion amount is calculated. That is, the control calculation portion 10 determines the correction efficiency P(S) as a small value as the self-weight flection amount S is larger, in other words, as the stiffness is smaller. Also as regards the abrasion amount per unit rotation, similarly, the correction calculation is made depending on the self-weight flection amount S and then is integrated.

As a result, also in either of the integration methods on the page number basis and on the rotation number basis, the abrasion amount of the parting layer 211S can be predicted with accuracy. A result of a prediction calculation on the page number basis is shown in (e) of FIG. 3. In (e) of FIG. 3, the abscissa is a predicted value ($10^{-4}$ μm/page) of the abrasion amount of the parting layer 211S by the method in this embodiment, and the ordinate is an actually measured value ($10^{-4}$ μm/page) of the abrasion amount of the parting layer 211S. In (e) of FIG. 3, a correlation efficiency $R^2$ is 0.73. This results is improved in prediction accuracy compared with the case where only the standard value is used and the case where the abrasion amount is calculated using the basis weight or the smoothness, and also accuracy of calculation of the lifetime of the fixing portion 21 made on the basis of the calculation result.

As described above, according to this embodiment, the degree of deterioration of the fixing portion 21 can be predicted and calculated with accuracy depending on the stiffness of the recording material, so that calculation of the lifetime of the fixing portion 21 depending on the use (operation) status of the user can be made with accuracy. The application range of this embodiment is not limited thereto, but for example, the stiffness may also be discriminated by a method other than the method of measuring the self-weight flection amount used in this embodiment. In the lifetime calculation, the degree of abrasion approaching the end of the lifetime value of the abrasion amount is represented by the percentage, but may also be represented by a remaining number of sheets of the recording materials capable of being subjected to the printing until the abrasion amount reaches the end of the lifetime thereof. Further, it is possible to use an arbitrary method such that the abrasion amount is represented on the basis of the number of days in view of the use status until then.

As described above, according to this embodiment, depending on the recording material to be fed, it is possible to estimate the degree of the lowering in performance of the feeding means with accuracy.

Embodiment 2

The result of the study in Embodiment 1 shows that the abrasion amount per unit page or unit rotation of the parting layer 211S has a strong correlation with the stiffness of the recording material. However, for example, as shown in (c) of FIG. 3, there is a slight difference in abrasion amount per unit page among the abrasion amounts of three species of the recording materials having values of the Clark stiffness of about 100 ($cm^3$/100).

According to further study by the present inventors, this difference is due to a difference in content (compounding amount) of a filler contained in the recording materials, and with an increasing content, the abrasion amount per unit page of the parting layer 211S becomes larger. In the case of a general-purpose copying paper, a main component of the filler is calcium carbonate, but the copying paper also contains the filler such as silica, titanium oxide, talc, clay and the like, as components other than the calcium carbonate. Therefore, in this embodiment, when the degree of deterioration of the rotation feeding means is predicted and calculated, not only the stiffness of the recording material but also the content of the filler contained in the recording material are used as parameters. Details thereof will be described below.

[Prediction Calculation]

Figure 5:
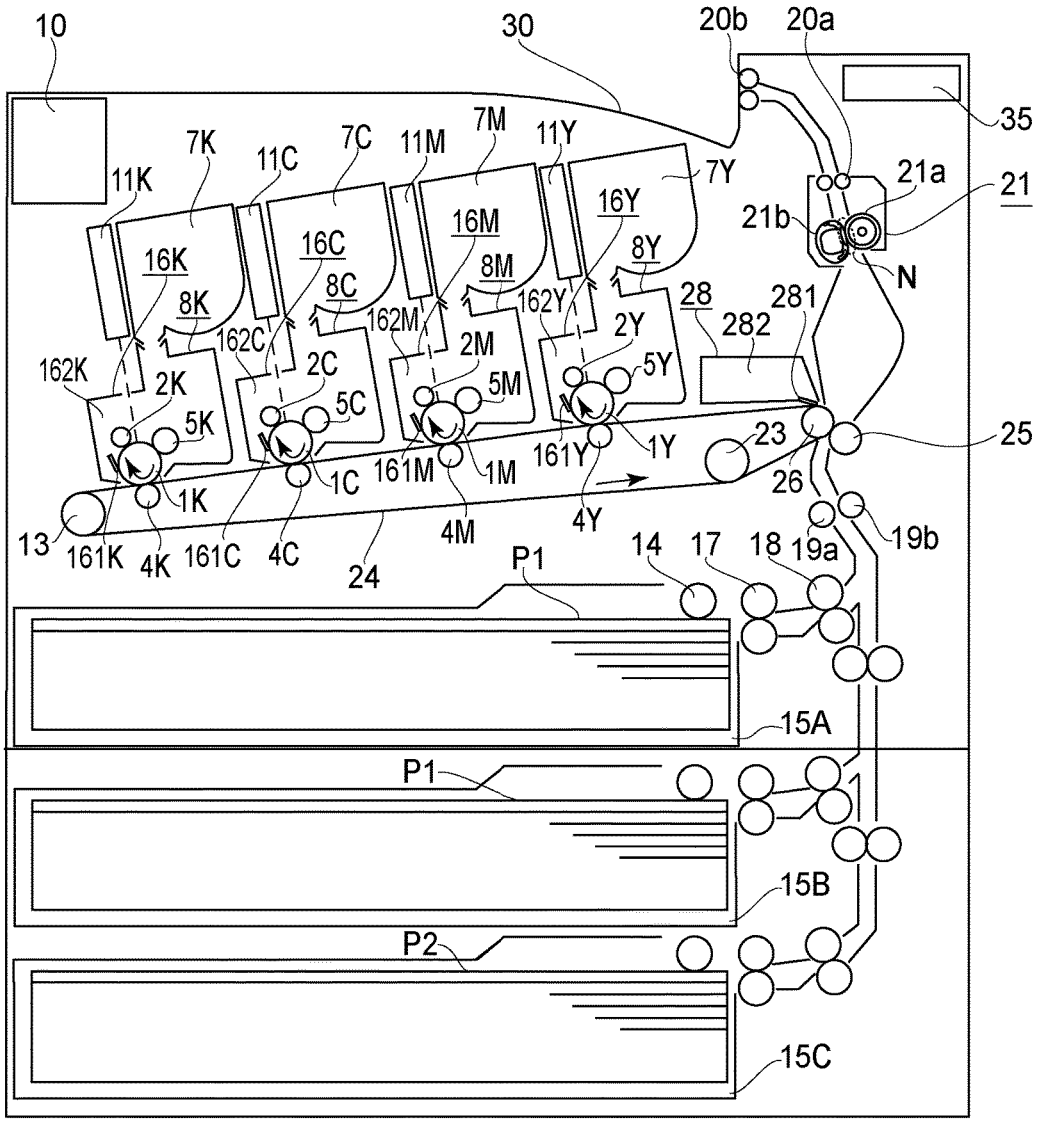
FIG. 5 is a schematic sectional view of an image forming apparatus in Embodiment 2.

FIG. 5 is a schematic sectional view of an image forming apparatus in this embodiment. An image forming operation and constituent parts of the image forming apparatus are similar to those described in Embodiment 1 with reference to FIG. 1 and therefore will be omitted from description by adding the same reference numerals or symbols, and only a difference from Embodiment 1 will be described. The image forming apparatus in this embodiment includes sheet feeding cassettes 15B and 15C which are mounted as options in addition to the sheet feeding cassette 15A mounted in the main assembly of the image forming apparatus.

The image forming apparatus in this embodiment employs a constitution in which data of the stiffness and the filler content of the recording material P are inputted by the user through a menu screen displayed on the control panel 35. The data of the stiffness and the filler content of the recording material P provided from manufacturers of the image forming apparatus and the recording material P are inputted into the image forming apparatus by the user through the control panel 35. In this embodiment, the filler content was acquired using an ash content testing method according to JIS P 8251. As a method other than this method, for example, by using a quantitative analysis method using fluorescent X-rays, the content of each of the above-described fillers is calculated every component and the sum of the contents of the fillers may be used as the content, or a particular component is noted and the content thereof may also be used as the content. Further, for measuring the stiffness of the recording material P, the Clark stiffness tester method according to JIS P 8143 is employed, but as described above in Embodiment 1, the values obtained by other methods may also be used.

Herein, the user includes both of a "general user" who executes the image formation on a particular recording material by using the image forming apparatus and an "management (administrative) user" who effects maintenance, management and the like of the image forming apparatus. The above-described pieces of information on the stiffness and the filler of the recording material P cannot be known in general by the general user in some cases, and therefore in this embodiment, input of these pieces of the information is made through the menu screen to which only the management user has access for the purpose of avoiding confusion of the general user.

On the menu screen displayed on the control panel 35, the input on the stiffness and the filler of the recording material P to be inputted can be individually set for each of the plurality of sheet feeding cassettes mounted in the image forming apparatus. In this embodiment, for each of the sheet feeding cassettes 15A and 15B, a recording material P1 of the same species (brand) is set and data of the same stiffness and the same filler content are inputted. For the sheet feeding cassette 15C, a recording material P2 higher in stiffness and filler content than the recording material P1 set in each of the sheet feeding cassettes 15A and 15B and data of the stiffness and the filler content which are associated with the recording material P2 are inputted. The data of the stiffness and the filler content inputted for each of the sheet feeding cassettes are held in the control calculation portion 10, and are used depending on the sheet feeding cassette used for image formation when the correction efficiency at the time when the prediction calculation of the degree of deterioration described later is made is calculated.

Also in this embodiment, similarly as in Embodiment 1, as the prediction calculation value of the degree of deterioration, the abrasion amount of the parting layer 211S in the heating film 211 is calculated and corrected depending on the stiffness and the filler content of the recording material held in the control calculation portion 10. That is, in the control calculation portion 10, the standard value of the abrasion amount of the parting layer 211S by the feeding of the recording material P is $0.84\times10^{-4}$ μm per page or $0.17\times10^{-5}$ μm/rotation of the heating film 211. Then, every feeding of one sheet of the recording material P and every (one) rotation of the heating film 211, the abrasion amount of the parting layer 211S is integrated and held. Then, the correction efficiency is obtained from a matrix shown in FIG. 6 depending on the stiffness and the filler content of the recording material P which are associated with the sheet feeding cassettes 15A to 15C used in the image formation, and then the standard value is corrected as shown in the above-described formula (2) similarly as in Embodiment 1.

Figure 6:
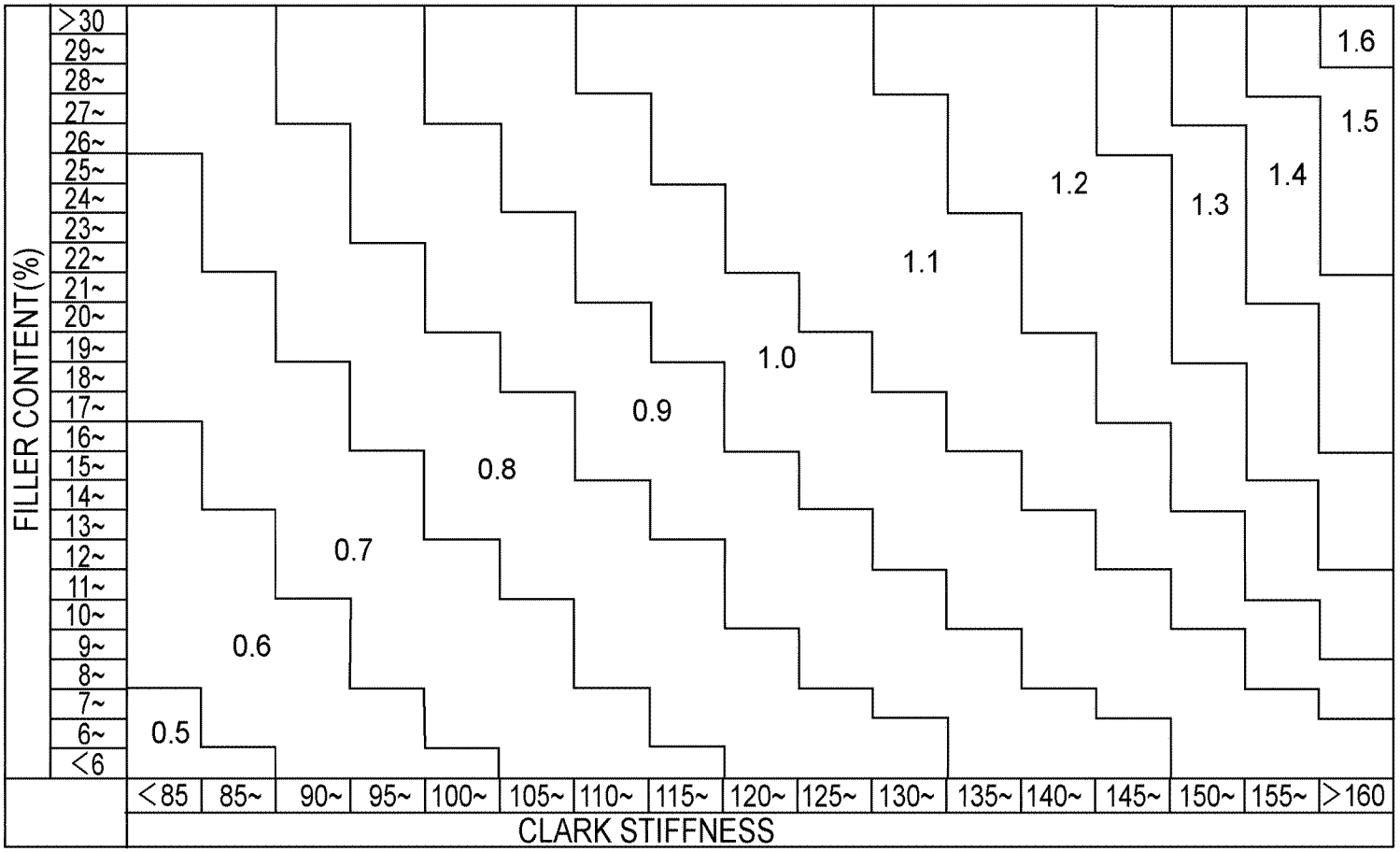
FIG. 6 is an illustration of a correction efficiency matrix in Embodiment 2.

FIG. 6 shows the matrix in which the abscissa is the Clark stiffness and the ordinate is the filler content (%) and in which the correction efficiency at a predetermined Clark stiffness and a predetermined filler content is shown. The correction efficiency is in the range from 0.5 to 1.6 similarly as in Embodiment 1. The correction efficiency is set at a smaller value with a decreasing stiffness and with a decreasing filler content. For example, in the case where the Clark stiffness inputted through the menu screen is 120 or more and less than 125 and the filler content (%) is 14 or more and less than 15, the correction efficiency is 0.9. As a result, also in either of the integration methods on the page number basis and on the rotation number basis, the abrasion amount of the parting layer 211S can be predicted further accurately. A result of a prediction calculation on the page number basis is shown in (f) of FIG. 3. In FIG. 3, (f) is a graph in which the abscissa is a predicted value ($10^{-4}$ μm/page) of the abrasion amount, and the ordinate is an actually measured value ($10^{-4}$ μm/page) of the abrasion amount of the parting layer 211S. A correlation efficiency $R^2$ obtained in the prediction calculation in this embodiment is 0.92, so that the accuracy of the predicted value is improved by adding the filler content into the prediction calculation. Accordingly, also the accuracy of the lifetime calculation made on the basis of the calculation result of this embodiment can be improved.

As described above, according to this embodiment, the degree of deterioration of the fixing portion 21 can be predicted and calculated with accuracy depending on the stiffness and the filler content of the recording material, so that calculation of the lifetime of the fixing portion 21 depending on the use (operation) status of the user can be made with accuracy. Further, in this embodiment, the stiffness and the filler content of the recording material P is held for each of the sheet feeding cassettes. As a result, even in the case where a plurality of species of the recording materials (papers) are used, the prediction calculation depending on each of the recording materials can be made, and therefore it is possible to obtain a result with accuracy in which the use status of the user is reflected more specifically.

In this embodiment, the stiffness and the filler content of the recording material P are held for each of the sheet feeding cassettes, but for example, the correction efficiency obtained from the matrix of FIG. 6 may also be stored for each of the sheet feeding cassettes. Further, in this embodiment, both of the data of the stiffness and the filler content are inputted through the control panel 35. However, for example, a constitution in which the stiffness is automatically detected depending on the detection result of the distance measuring sensor 40 as described in Embodiment 1 and only the filler content is inputted through the control panel 35 may also be employed. Further, in the case where a detecting means for detecting the filler content is provided, the filler content is automatically detected by the detecting means and then can also be used in the above-described prediction calculation. Further, a constitution in which the above-described input of the data through the control panel 35 is made from not only the menu screen to which only the management user has access but also a menu screen to which the general user has access as desired may also be employed.

As described above, according to this embodiment, it is possible to accurately estimate the degree of the lowering in performance of the feeding means depending on the recording material to be fed.

Embodiment 3

When the user sets parameters relating to many recording materials P for an individual image forming apparatus, there is a liability that usability lowers. Further, as described above, the data of the stiffness and the filler content of the recording material P are known only by the management user of the image forming apparatus but cannot be known by the general user in some cases. In these cases, these parameters are set by the management user. However, in the case where the management user manages a plurality of image forming apparatuses and a plurality of sheets, for an individual image forming apparatus, the management user repetitively makes setting of the parameters of the same sheet many times. When such a setting operation can be performed at one time, an operation efficiency of the management user can be improved. Therefore, in this embodiment, a constitution in which the data of the stiffness and the filler content of the recording material are inputted from a host device via a network circuit will be described.

Figure 7A:
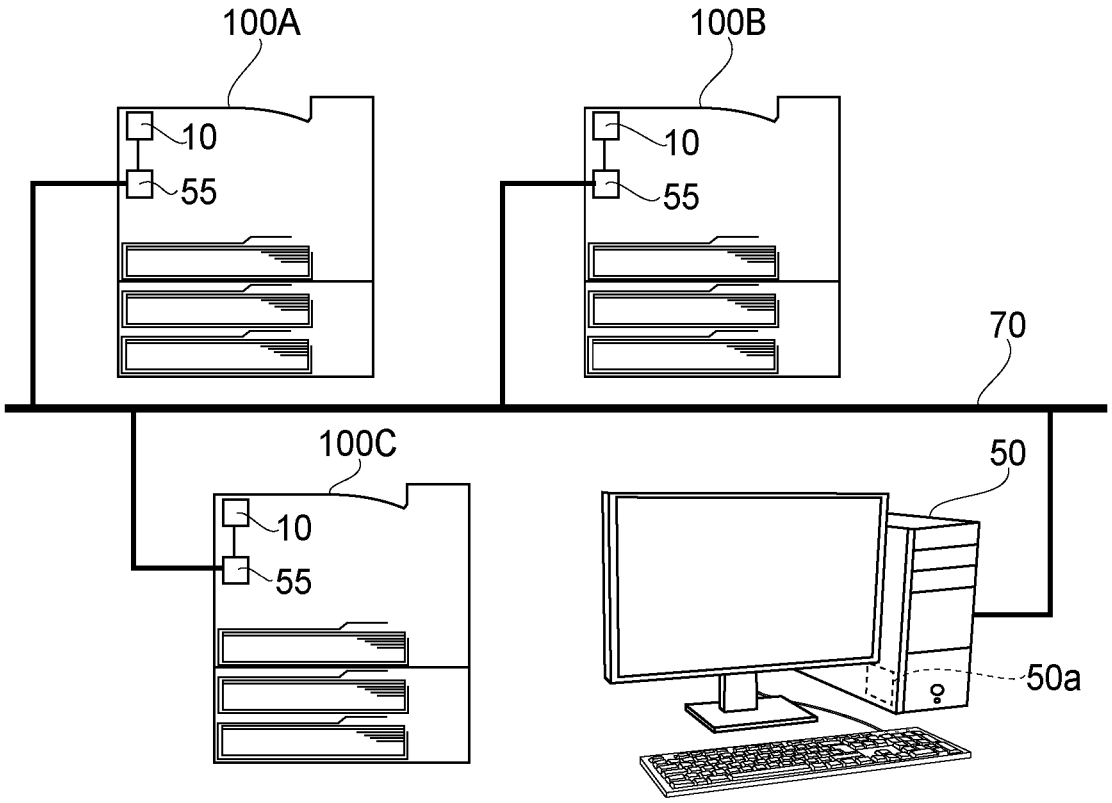
FIG. 7A is an illustration of an image forming apparatus and a management system in Embodiment 3.

FIG. 7A is a schematic view showing a connection state of a plurality of image forming apparatuses 100A to 100C and a host device 50 in this embodiment. All of the image forming apparatuses 100A to 100C are connected with the network circuit 70 through associated network connecting devices 55. The host device 50 includes a controller 50*a* which is a setting means. The controller 50*a* of the host device 50 is capable of inputting the data of the stiffness and the filler content of the recording material P for each of the sheet feeding cassettes 15 of the image forming apparatuses 100A to 100C via the network circuit 70. In each of the image forming apparatuses 100A to 100C, the network connecting device 55 is connected with an associated control calculation portion 10, and the data of the stiffness and the filler content of the recording material P inputted through the network circuit 70 are held (stored) in the control calculation portion 10 also functioning as a storing means. Constitutions, operations, calculations of the degree of deterioration, and the like of the image forming apparatuses 100A to 100C are similar to those described in Embodiments 1 and 2, and similar constituent members or portions are represented by the same reference numerals or symbols and will be omitted from description.

The host device 50 is connected with the image forming apparatuses 100A to 100C through the same network circuit 60, so that the host device 50 is capable of effecting centralized control (management) of settings of the image forming apparatuses 100A to 100C and monitoring of an operation status. When the data of the stiffness and the filler content of the recording material P are sent from the host device 50, for example, by using a management screen as shown in FIG. 7B, the host device 50 selects the image forming apparatus which is a destination.

Figure 7B:
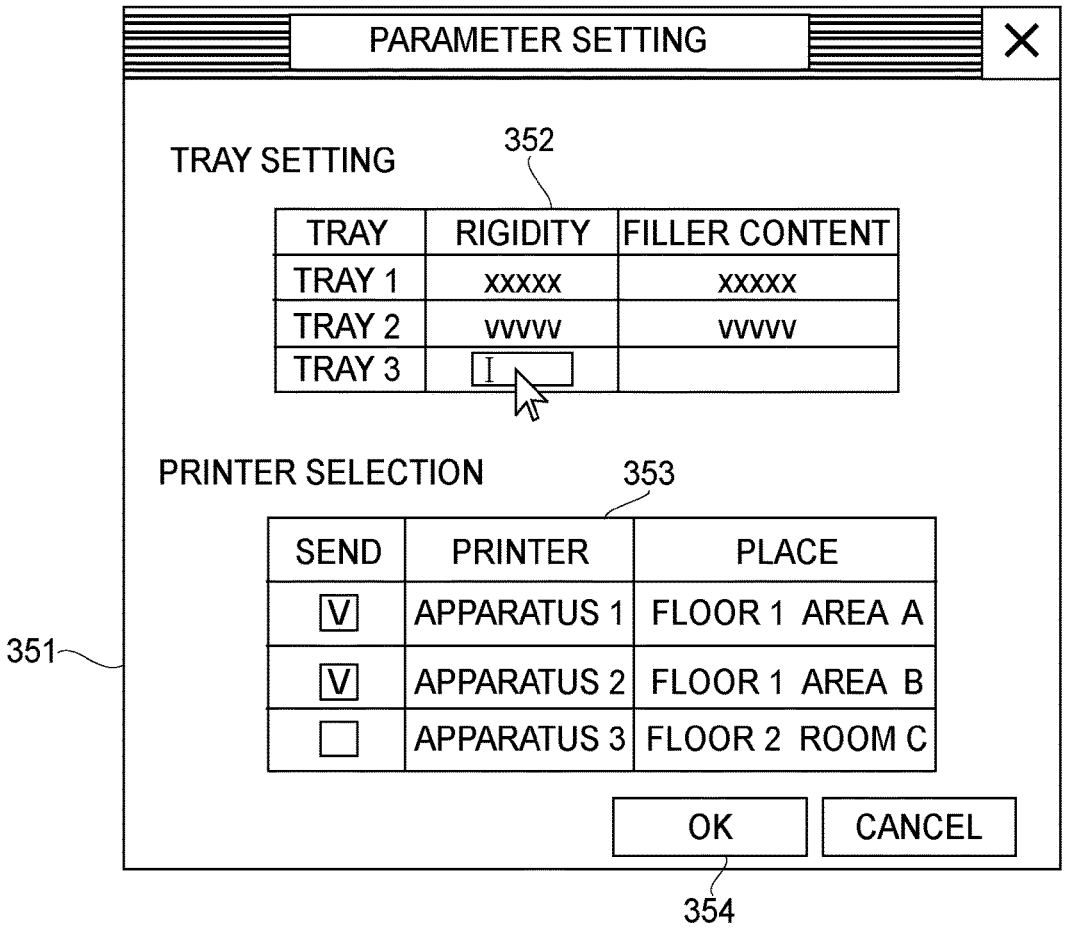
FIG. 7B is an illustration of a management screen displayed on a host device in Embodiment 3.

FIG. 7B is a management screen 351. On the management screen 351, a "sheet parameter management setting menu ("PARAMETER SETTING")" is displayed, and data of a tray setting input portion 352 and a setting sending printer selection portion 353 can be inputted. At the tray setting input portion 352, data of the stiffness and the filler content of the recording material P set in each of trays 1 to 3 corresponding to the sheet feeding cassettes 15A to 15C, respectively, can be inputted. Further, at the setting sending printer selection portion 353, information on an installation place of each of image forming apparatuses 1 to 3 corresponding to the image forming apparatuses 100A to 100C, respectively, is displayed. At the setting sending printer selection portion 353, sending of the data of the stiffness and the filler content set at the tray setting input portion to what image forming apparatus can be set by checking a check box. In this embodiment, a constitution in which the data of the stiffness and the filler content are set through the management screen 351 is employed, but a constitution in which at least one of the stiffness and the filler content is set may also be employed. For example, a constitution in which the filler content is inputted through the management screen 351 and the stiffness is obtained on the basis of a detection result of the distance measuring sensor 40 and then the degree of deterioration is calculated using these values may also be employed. Even in the case where the stiffness is inputted through the management screen 351, the degree of deterioration may also be calculated using the stiffness on the basis of the detection result of the distance measuring sensor 40.

For example, in FIG. 7B, check boxes of the image forming apparatus 1 corresponding to the image forming apparatus 100A and the image forming apparatus 2 corresponding to the image forming apparatus 100B are checked. For this reason, common stiffness and filler content are set for the trays 1 to 3 of each of the image forming apparatuses 1 and 2. After these data are inputted by the user, the controller 50*a* of the host device 50 sends these pieces of information to corresponding controllers 10 of the image forming apparatuses 100A to 100C by pressing down on OK button 354 by the user. As a result, the host device 50 can effect centralized control of the image forming apparatuses 100A to 100C. In this embodiment, the constitution in which the data of the stiffness and the filler content are inputted is employed, but a constitution in which at least one of the stiffness and the filler content is inputted may only be required to be employed.

As individual discrimination (identification) information of the image forming apparatus, an IP address or the like registered for the image forming apparatus is used, and thus individual discrimination can be made using a known method. In this manner, the host device 50 sends the data of the stiffness and the filler content to the plurality of the image forming apparatuses selected through the management screen 351 for each of the sheet feeding cassettes 15 to at one time.

As described above, by using the data of the stiffness and the filler content inputted via the network circuit 60, the control calculation portion 10 of each of the image forming apparatuses can make the lifetime calculation of the fixing portion 21 with accuracy. Further, a result of the lifetime calculation made in each of the image forming apparatuses is sent to the host device 50 via the network circuit 60. As a result, the host device 50 can hold the lifetime calculation result of the fixing portion 21 of each of the image forming apparatuses as one of pieces of maintenance management information, so that the host device 50 can also alleviate a management load of the management user.

As described above, a management system of the image forming apparatus is constructed, so that the data of the stiffness and the filler content of the recording material can be inputted by a one-time operation into the plurality of the image forming apparatuses, inclusive of the sheets to be used, by a one-time operation. As a result, an operation load of the management user can be considerably reduced.

In the above-described embodiments, as an object to be subjected to the prediction calculation of the degree of deterioration, the heating film 211 was used, but the present invention is not limited thereto. For example, other than the heating film 211, the present invention may also be applied to the pressing roller 21*a* which is a part constituting the fixing portion 21. Further, only the prediction calculation value of the degree of deterioration of the heating film 211 is used in the lifetime calculation of the fixing portion 21, but the lifetime calculation may also be made in comprehensive consideration of the degree of deterioration and the like of the other parts constituting the fixing portion 21 as described above. Further, the present invention is also application to the rotation feeding means in general, which contributes to the feeding of the recording material in contact with the surface of the recording material P, such as the secondary transfer roller 25 or the feeding rollers 17 and 18, other than the fixing portion 21.

As described above, according to this embodiment, depending on the recording material to be fed, the degree of the lowering in performance of the feeding means can be estimated with accuracy.

Embodiment 4

In this embodiment, an image forming apparatus in which a lifetime of the rotation feeding means constituting the image forming apparatus is calculated on the basis of a characteristic value corresponding to the recording material registered for each of sheet feeding cassettes and manually feeding trays will be described. A constitution in which even in the case where a recording material different from the recording material registered for each of the sheet feeding cassettes and the manually feeding trays in such an image forming apparatus is used, the different recording material is discriminated and then the lifetime calculation of the rotation feeding means is made will be described.

[Image Forming Apparatus and Fixing Portion]

Figure 8:
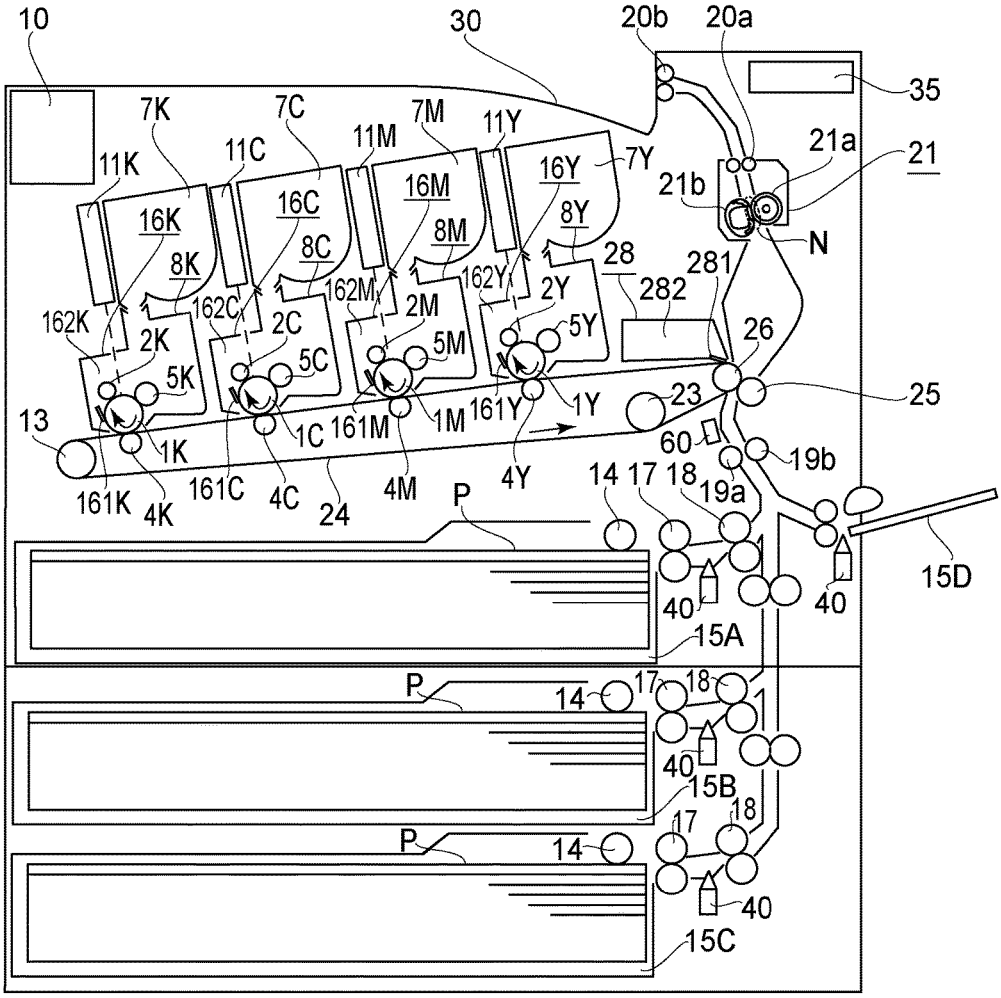
FIG. 8 is a schematic sectional view of an image forming apparatus in Embodiments 4 and 5.

FIG. 8 is a schematic sectional view of an image forming apparatus in this embodiment. An image forming operation and constituent parts of the image forming apparatus are similar to those described in Embodiment 1 with reference to FIG. 1 and therefore will be omitted from description by adding the same reference numerals or symbols, and only a difference from Embodiment 1 will be described. The image forming apparatus in this embodiment includes, as a placing portion where the recording material P is placed, a manually feeding tray 15D and sheet feeding cassettes 15B and 15C which are mounted as options in addition to the sheet feeding cassette 15A mounted in the main assembly of the image forming apparatus. Incidentally, constituent elements of the fixing portion 21 in this embodiment are similar to those in Embodiment 1 described with reference to FIG. 2, and therefore will be omitted from description.

[Calculating Method of Lifetime]

In this embodiment, a method in which the degree of deterioration of the fixing portion 21 is predicted and calculated and on the basis of the thus-calculated value, lifetime calculation of the fixing portion 21 is made will be described. As regards the lifetime of the fixing portion 21 in this embodiment, image defect with abrasion of the parting layer 211S of the heating film 211 is a factor for determining a degree of progress of the degree of deterioration. In the image forming apparatus used in this embodiment, the control calculation portion 10 uses $0.84\times10^{-4}$ μm/page as a standard value of the abrasion amount of the parting layer 211S by the feeding of the recording material P and calculates and holds the abrasion amount every feeding of a single sheet of the recording material P.

In an environment in which the image forming apparatus is actually used, accuracy of the prediction calculation is improved in some cases when the abrasion amount per unit number of rotation of the heating film 211 is used as a basis rather than when the abrasion amount per unit page is used as the basis. Therefore, in this embodiment, also the number of rotations of the heating film 211S is actually measured, and the abrasion amount is calculated using $0.17\times10^{-5}$ μm/rotation as the standard value of the abrasion amount and is integrated and held. Then, the lifetime calculation in which a degree that the integrated abrasion amount approaches a predetermined lifetime value of the fixing portion 21 is represented by a percentage is made. As described above, an initial value of the thickness of the parting layer 211S used in this embodiment is 25 μm. However, there is a liability that when the abrasion of the parting layer 211S progresses and the thickness of the parting layer 211S becomes extremely thin, a minute crack generates in the parting layer 211S and an effect of a parting performance is not sufficiently achieved and thus an image quality lowers. Accordingly, in this embodiment, the lifetime value of the integrated abrasion amount of the parting layer 211S is 23 μm, and the lifetime calculation is made by the above-described formula (1) in Embodiment 1. The formula (1) will be omitted from detailed description.

Incidentally, it has been known that the abrasion amount of the parting layer 211S varies depending on the species of the recording material to be fed. According to study by the present inventors, it turned out that the abrasion amount of the parting layer 211S can be predicted with accuracy by taking the stiffness of the recording material P and the content of the filler contained in the recording material P into consideration. That is, with increasing stiffness of the recording material P and with an increasing content of the filler contained in the recording material P, the abrasion amount per unit page becomes larger. In the case of a general-purpose copying paper, a main component of the filler contained in the recording material is calcium carbonate, but the filler also contains silica, titanium oxide, talc, clay and the like in addition to the calcium carbonate. Therefore in this embodiment, when the degree of deterioration of the rotation feeding means is predicted and calculated, the stiffness of the recording material and the content of the filler contained in the recording material are used as parameters.

In this embodiment, the filler content is acquired using a method ("Paper, board and pulps-Determination of residue (ash) on ignition at 525 degree C.") according to JIS P 8251. As a method other than this method, for example, by using a quantitative analysis method using fluorescent X-rays, the content of each of the above-described fillers is calculated every component and the sum of the contents of the fillers may be used as the content, or a particular component is noted and the content thereof may also be used as the content.

Further, as a measuring method of the stiffness of the recording material in the above study, the Clark stiffness tester method according to JIS P 8143 is employed. As another method correlated with the Clark stiffness, for example, the Gurley method according to Japan TAPPI No. 40, the Taber stiffness tester method according to JIS P 8125, or a simple method according to TAPPI UM409 or the like is used. Even when these methods having correlation with the Clark stiffness are used for measuring the stiffness, it would be considered that a similar correlation with the abrasion amount of the parting layer 211S can be obtained.

As the prediction calculation value of the degree of deterioration, the abrasion amount of the parting layer 211S in the heating film 211 is calculated and corrected depending on the stiffness and the filler content of the recording material held in the control calculation portion 10. That is, in the control calculation portion 10, the standard value of the abrasion amount of the parting layer 211S by the feeding of the recording material P is $0.84\times10^{-4}$ μm per page or $0.17\times10^{-5}$ μm/rotation of the heating film 211. Then, every feeding of one sheet of the recording material P and every (one) rotation of the heating film 211, the abrasion amount of the parting layer 211S is integrated and held.

The image forming apparatus in this embodiment includes the sheet feeding cassettes 15B and 15C which are mounted as options in addition to the sheet feeding cassette 15A and the manually feeding tray 15D which are mounted to the main assembly of the image forming apparatus. With each of the sheet feeding cassettes 15A-15C and the manually feeding tray 15D (hereinafter also referred to as "sheet feeding cassettes 15A and the like"), the stiffness and the filler content of a corresponding recording material are associated. The control calculation portion 10 acquires a correction efficiency P(S) in a range from 0.5 to 1.6 from a matrix shown in FIG. 6 depending on the stiffness and the filler content of the corresponding recording material P, and then the abrasion amount per page is multiplied by the above-described standard value ($0.84\times10^{-4}$ μm) and is integrated for each of pages (sheets).

FIG. 6 shows the matrix in which the abscissa is the Clark stiffness and the ordinate is the filler content (%) and in which the correction efficiency P(S) at a predetermined Clark stiffness and a predetermined filler content is shown. The correction efficiency P(S) is in the range from 0.5 to 1.6. The correction efficiency P(S) is set at a smaller value with a decreasing stiffness and with a decreasing filler content. For example, in the case where the Clark stiffness inputted through the menu screen is 120 or more and less than 125 and the filler content (%) is 14 or more and less than 15, the correction efficiency P(S) is 0.9.

Thus, the control calculation portion 10 acquires an integrated abrasion amount W (μm) from the above-described formula (2) in Embodiment 1. The formula (2) will be omitted from detailed description. The correction efficiency P(S) is smaller with decreasing stiffness of the recording material and with a decreasing filler content, and on the other hand, is larger with increasing stiffness of the recording material and with an increasing filler content. The integrated abrasion amount may only be required to be acquired using at least one of a page number-based integration method and a rotation number-based integration method and may also be acquired using both of these methods.

The control calculation portion 10 of the image forming apparatus includes a list indicating species of the recording materials (media) which are frequently used in general by the user and indicating associated stiffness and filler content of the recording materials as shown in Table 1 below. The control calculation portion 10 obtains the correction efficiency P(S) from the matrix of FIG. 6 while making reference to the stiffness and the filler content depending on the recording material used by the user, and can correct the integrated abrasion amount W.

TABLE 1

| MEDIA | BW*1 (g/m²) | TH*2 (mm) | BS*3 (sec) | CS*4 (mN) | FC*5 (%) |
|---|---|---|---|---|---|
| A | 76.48 | 0.105 | 24.54 | 96.91 | 16.52 |
| B | 76.78 | 0.102 | 32.88 | 109.12 | 21.31 |
| C | 77.06 | 0.105 | 29.29 | 106.19 | 19.41 |
| D | 76.51 | 0.105 | 22.28 | 92.35 | 24.18 |
| E | 76.42 | 0.104 | 31.14 | 90.25 | 17.82 |
| F | 76.64 | 0.104 | 31.72 | 82.42 | 17.46 |
| G | 76.83 | 0.103 | 30.13 | 87.16 | 17.92 |
| H | 75.13 | 0.103 | 21.25 | 130.78 | 18.43 |
| I | 91.22 | 0.117 | 30.33 | 111.19 | 23.65 |
| J | 76.58 | 0.105 | 28.32 | 116.35 | 19.58 |
| K | 68.84 | 0.093 | 26.44 | 88.18 | 25.35 |
| L | 80.01 | 0.107 | 59.05 | 130.78 | 16.04 |
| M | 88.19 | 0.108 | 46.37 | 152.90 | 20.81 |
| N | 71.85 | 0.097 | 25.50 | 101.34 | 25.42 |
| O | 81.60 | 0.112 | 27.92 | 139.28 | 23.58 |
| P | 72.38 | 0.094 | 47.31 | 105.90 | 10.91 |
| Q | 80.98 | 0.094 | 135.76 | 101.62 | 16.38 |
| R | 54.71 | 0.067 | 80.50 | 37.24 | 18.99 |
| S | 78.82 | 0.131 | 5.27 | 123.58 | 9.64 |
| T | 84.07 | 0.117 | 14.28 | 84.15 | 24.6 |
| U | 70.63 | 0.087 | 104.41 | 72.56 | 12.99 |
| V | 128.70 | 0.111 | 577.80 | 85.15 | 38.74 |

*1"BW" is a basis weight.
*2"TH" is the thickness.
*3"BS" is the Bekk smoothness.
*4"CS" is the Clark stiffness.
*5"FC" is the filler content.

In Table 1, the first column represents the species (brands) A to V, the second column represents the basis weight (g/m²) of each recording material, the third column represents the thickness (mm) of each recording material, the fourth column represents the Bekk smoothness (sec) of each recording material as measured by the Bekk measuring method, the fifth column represents the Clark stiffness (mN) of each recording material as measured by the Clark stiffness tester method, and the sixth column represents the filler content (%) of each recording material. For example, the recording material (media) D is 76.51 g/m² in basis weight, 0.105 mm in thickness, 22.28 sec in Bekk smoothness, 92.35 mN in Clark stiffness and 24.18% in filler content.

[Prediction Calculation Result and Actually Measured Value of Abrasion Amount]

Figure 9:
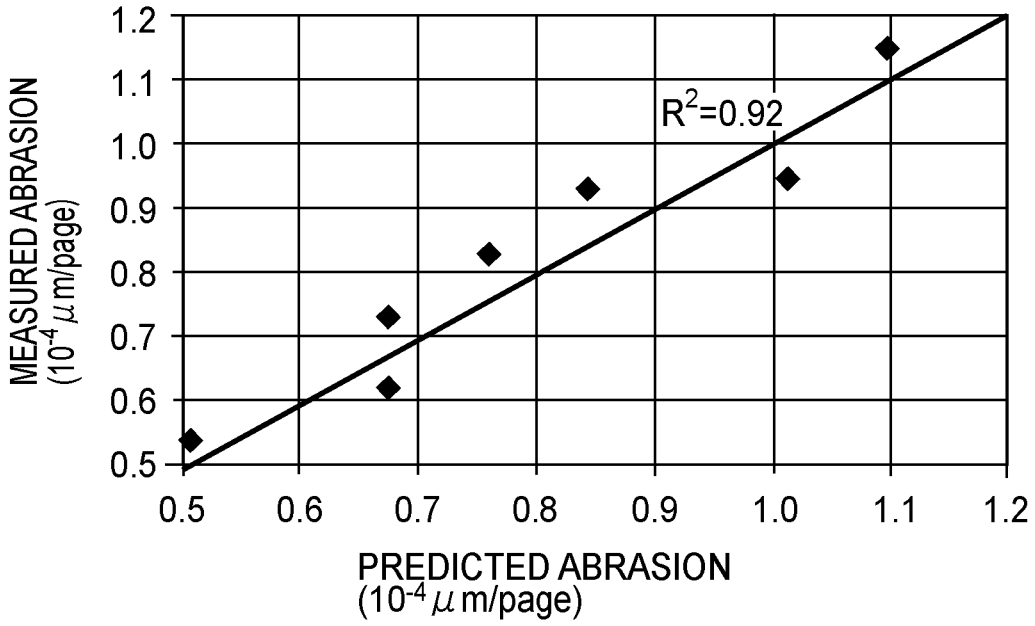
FIG. 9 is a graph showing a correlation between a predicted value and an actually measured value of an abrasion amount in Embodiment 4.

FIG. 9 shows a result of prediction calculation of the abrasion amount in the case where the page number is used as a basis thereof. In FIG. 9, (f) is a graph in which the abscissa is a predicted value ($10^{-4}$ μm/page) of the abrasion amount, and the ordinate is an actually measured value ($10^{-4}$ μm/page) of the abrasion amount of the parting layer 211S. A correlation efficiency $R^2$ at this time is 0.92. Incidentally, also a result of prediction calculation made on the basis of the number of rotations of the parting layer 211S (heating film 211) can similarly provide a high correlation efficiency. Thus, in either of the page number-based integration method and the rotation number-based integration method, the abrasion amount of the parting layer 211S can be predicted with accuracy.

The abrasion amount by the recording material fed from each of the sheet feeding cassettes 15A and the like is individually calculated as Wa, Wb, We or Wd in accordance with the above-described formula (2). The suffixes a to d correspond to the suffixes A to D, respectively, of the sheet feeding cassettes 15A and the like. The integrated abrasion amount W can be obtained by the following formula (3).

$$W=Wa+Wb+We+Wd \quad (3)$$

As described above, the control calculation portion 10 acquires the integrated abrasion amount for each of the sheet feeding cassettes 15A and the like and adds up the abrasion amounts for the sheet feeding cassettes 15A and the like, so that the integrated abrasion amount of the parting layer 211S is calculated.

(When changed to recording material listed in Table 1)

It is also assumed in some cases that the user changes the recording material to a recording material different from the recording material registered for the sheet feeding cassettes 15A and the like. Also in these cases, in this embodiment, the abrasion amount can be estimated with accuracy. In the following, the case where the recording material from the sheet feeding cassette 15A is fed will be described as an example. The control calculation portion 10 discriminates that the recording material was changed on the basis of pulling-out and insertion of the sheet feeding cassettes 15A-15C or on the basis of a detection result of an unshown sensor or the like for detecting the presence or absence of the recording material on the manually feeding tray 15D, for example.

In the case where the user uses the recording material listed in Table 1, the user is capable of selecting the species of the recording material to be used by the user from the list through the menu screen displayed at the control panel 35. The control panel 35 functions as a display portion and a selecting means. As a result, it is possible to associate the species of the recording material in the list of Table 1 and the sheet feeding cassettes 15A and the like with each other. The control calculation portion 10 as an identifying means discriminates that the recording material was changed, on the basis of information inputted through the control panel 35, in other words, on the basis of a selection result, and thus identifies the recording material after the change. As a result, a state of the lifetime calculation with accuracy can be maintained for the species of the recording materials listed in Table 1.

For example, the case where the recording material is changed from a first registered recording material, in other words, from the recording material before the change to another recording material listed in Table 1 will be described. In this case, the control calculation portion 10 acquires each of an integrated abrasion amount Wa_1 when the first registered recording material is fed and an integrated abrasion amount Wa_2 when the recording material after the change is fed. The control calculation portion 10 acquires the integrated abrasion amount Wa of the parting layer 211S by the recording material fed from the sheet feeding cassette 15A from the sum of the integrated abrasion amount Wa_1 and the integrated abrasion amount Wa_2. That is, the control calculation portion 10 obtains the integrated abrasion amount Wa for the sheet feeding cassette 15A from the following formula (4).

$$Wa=Wa_1+Wa_2 \quad (4)$$

(When changed to recording material which is not listed in Table 1)

There can arise the case where the user changes the recording material to a recording material which is not listed in Table 1. In the case where the user uses the recording material which is not listed in Table 1, in this embodiment, a constitution in which the user selects "another recording material" through the menu screen displayed on the control panel 35 is employed. In the case where "another recording material" is selected on the menu screen of the control panel 35, the control calculation portion 10 calculates the integrated abrasion amount W by using a tentative correction efficiency P(Sx) in accordance with the formula (2). A integrated abrasion amount calculated using the tentative correction efficiency P(Sx) in a period in which "another recording material" is used is Wa_x or the like.

In the case where "another recording material" is selected, the control calculation portion 10 stores the integrated abrasion amount Wa_x or the like for each of the sheet feeding cassettes 15A and the like separately from the integrated abrasion amount Wa_1 and the like before the change of the recording material. Here, when data of the stiffness and the filler content of the recording material are provided from manufactures of the image forming apparatus and the recording material correspondingly to the species of the recording material designated as "another recording material", the following constitution can be employed. That is, a constitution such that "another recording material" which is not originally listed in Table 1 is added as new information to the list of Table 1 so as to be inputted and registered is employed. In the case where "another recording material" is newly registered in the list of Table 1, the control calculation portion 10 acquires a correction efficiency P(Snew) depending on the newly registered recording material. That is, the control panel 35 functions as a registration means. Then, for example, for the sheet feeding cassette 15A, the control calculation portion 10 can calculate the lifetime again in accordance with the following formula (5). This is also true for the sheet feeding cassette 15B and the like.

$$\text{Integrated abrasion amount } Wa = Wa_1 + Wa_x \times P(Snew)/P(Sx) \quad (5)$$

In this embodiment, when "another recording material" is selected, as the tentative correction efficiency P(Sx), for example, 1.6 which is the largest value of possible values of the correction efficiency P(S) is used. This can also be said that a characteristic value of the recording material, of the recording materials usable in the image forming apparatus, providing the largest abrasion amount of the parting layer 211S is used as a tentative characteristic value. This method is employed in view of the case where when the species of the recording material used by the user is not listed in Table 1 and the recording material providing the largest abrasion amount of the parting layer 211S is used, the recording material is continuously used without registering its information in the list of Table 1. As a result, even in the case where "another recording material" is continuously used without being registered in the list of Table 1, it is possible to reduce a degree of the influence on the image and the image forming apparatus.

In this embodiment, a constitution based on the premise that the data of the recording material which is not listed in Table 1 is to be quickly inputted by the user is employed. This is because in an MSP environment in which the above-described management user exists, the above-described operation form can be used relatively easily.

On the other hand, when the recording material is continuously used without registering its information into the list, there is a liability that the following matter generates. Even when the recording material used is a recording material advantageous from abrasion of the parting layer 211S, i.e., even in the case where the abrasion of the parting layer 211S does not proceed in actuality, the image forming apparatus discriminates in some cases that the fixing portion 21 reaches the end of the lifetime thereof. Particularly, in the case where a possible maximum value of the correction efficiency P(S) is used as the tentative correction efficiency P(Sx), such cases are liable to generate. Accordingly, it is also assumed that the fixing portion 21 reaches the end of the lifetime thereof without registering the information into the list, and the following constitution may also be employed so that a difference between the actually measured abrasion amount of the parting layer 211S and the predicted abrasion amount becomes small even in such a case. That is, the tentative correction efficiency P(Sx) corresponding to "another recording material" may also be determined in view of a printing mode (printing speed) or the like of "plain paper", "thin paper", "thick paper" or the like set by the user. In general, the stiffness is higher with an increasing thickness, and therefore for example, a possible value of the tentative correction efficiency P(Sx) is 1.0-1.6 in a "thick paper" mode, 0.8-1.3 in a "plain paper" mode, and 0.5-1.0 in a "thin layer" mode.

The above-described information on the stiffness and the filler content of the recording material cannot be known by the general user usually in some cases, and therefore in this embodiment, input of these pieces of information is made through the menu screen to which the management user has access. Further, also registration of the species of the recording material normally used in the sheet feeding cassettes 15A and the like may be made by the management user. In the case where the general user other than the management user inputs these values, a constitution in which characteristic values of the recording material can be directly inputted through the menu screen may also be employed. In this embodiment, an abrasion amount integration method was described using the recording material fed from the sheet feeding cassette 15A as an example, but may also be applied similarly to the recording materials fed from other sheet feeding cassettes 15B and the like.

As described above, according to this embodiment, even in the case where the recording material is changed, depending on the recording material, a degree of the lowering in performance of the feeding means can be estimated with accuracy.

Embodiment 5

Depending on a user, the user changes the recording material used at a relatively high frequency in some cases. For such a user, an operation in which the species of the recording material is inputted and registered every change of the recording material is problematic from the viewpoint of usability. Further, depending on a user, even in the case where the recording material is changed, there is also a liability that the user does not input information on the recording material for registering new information in the list of Table 1. In this embodiment, a constitution in which the image forming apparatus includes a stiffness sensor, a surface smoothness sensor and a thickness sensor as detecting means for detecting characteristics of the recording material is employed. The control calculation portion 10 as a discriminating means has a constitution in which discrimination of the recording material is made on the basis of pieces of information detected by these detecting means. On the other hand, in general, it is difficult for the sensors provided in the image forming apparatus to management measures the filler content of the recording material, and therefore in this embodiment, a constitution in which the species of the recording material is predicted on the basis of detection results of the stiffness sensor, the surface smoothness sensor and the thickness sensor and then the filler content is acquired is employed.

The image forming apparatus in this embodiment has a list of species of the recording materials as shown in Table 1 similarly as in Embodiment 4, in which as characteristic values of the recording materials, not only the stiffness and the filler content but also the surface smoothness and the thickness of the recording material are listed. The control calculation portion 10 is capable of acquiring information on the stiffness, the surface, the surface smoothness and the thickness of the recording material by the above-described sensors.

[Distance Measuring Sensor]

The image forming apparatus in this embodiment includes the distance measuring sensor 40 described in Embodiment 1 in order to detect the stiffness of the recording material P. A constitution of the distance measuring sensor 40 is similar to that described in Embodiment 1 with reference to FIG. 4, and therefore will be omitted from description.

[Surface Smoothness/Thickness Sensor]

Figure 10:
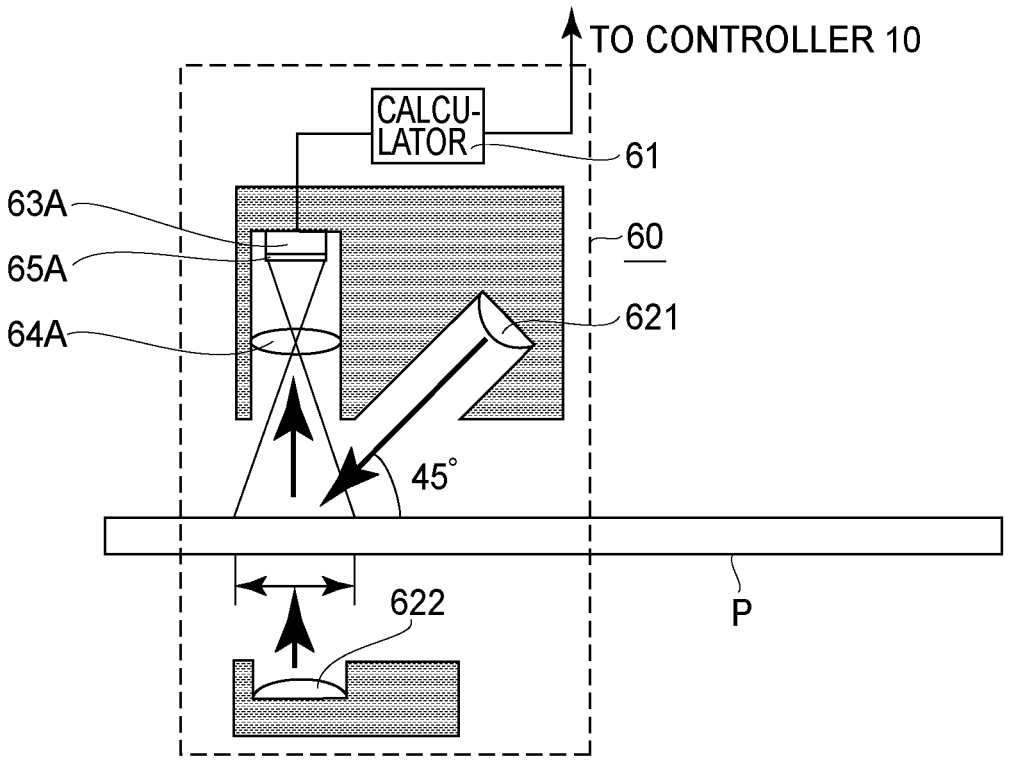
FIG. 10 is a schematic view showing a surface smoothness/thickness sensor in Embodiment 5.

FIG. 10 is a schematic sectional view showing a general structure of a surface smoothness/thickness sensor 60 in which a surface smoothness sensor and a thickness sensor are integrally assembled into a unit. The sensor 60 includes an LED 621 as a first light-emitting means, an LED 622 as a second light-emitting means, a CMOS area sensor 63A as an image pickup means and an imaging lens 64A as an imaging means. The sensor 60 further includes a filtering portion 65A constituting a filtering means and a calculating portion 61. Light emitted from the LED 621 as a light source is blue light having a maximum wavelength in the neighborhood of 460 nm and is emitted toward the surface of the recording material P.

The blue LED 621 is disposed so that the surface of the recording material P is irradiated with the light at an angle of 45 degrees with respect to the surface of the recording material P, so that reflected light having a shadow depending on unevenness of the surface of the recording material P is generated. The reflected light is focused via the imaging lens 64A, and of the reflected light, a wavelength component passing through the filtering portion 65A form an image as a reflected light image on the CMOS area sensor 63A. The CMOS area sensor 63A outputs a voltage signal as an electric signal varying depending on a reflected light quantity for each of image-formed areas, to the calculating portion 61. When the voltage signal is inputted from the CMOS area sensor 63A into the calculating portion 61, the calculating portion 61 subjects the voltage signal to analog-digital (A-D) conversion and outputs a digital signal with 256 gradation levels after the conversion, to the control calculation portion 10.

On the other hand, light emitted from the LED 622 as a light source is red light having a maximum wavelength in the neighborhood of 640 nm and is emitted toward a surface of the recording material P opposite from the surface irradiated with the light from the LED 621. The red LED 622 is disposed so that the surface of the recording material P is irradiated with the red light in a direction of normal thereto, and the red light passes through the recording material P in an attenuation amount depending on the thickness of the recording material P. Also this transmitted light is focused via the imaging lens 64A and a wavelength component passed through the filtering portion 65A forms an image as a transmitted light image on the CMOS area sensor 63A. The CMOS area sensor 63A outputs a voltage signal as an electric signal varying depending on a transmitted light quantity, to the control calculation portion 10. Then, by a similar action, the calculating portion 61 subjects the voltage signal to the A-D conversion and outputs a digital signal with 256 gradation levels after the conversion, to the control calculation portion 10. Incidentally, the light emitted from the red LED 622 transmits the recording material P in an attenuation amount also depending on the basis weight of the recording material P, and therefore the basis weight of the recording material P may also be detected by the sensor 60.

As described above, the sensor 60 in this embodiment outputs information on a surface unevenness property and information on the thickness of the recording material P to the control calculation portion 10. On the basis of the pieces of the information detected by the sensor 60, the control calculation portion 10 identifies the recording material from Table 1 and makes the lifetime calculation by using the stiffness and the filler content of the recording material P. That is, the control calculation portion 10 also functions as an identifying means. For example, in the case where the sensor 60 detects the surface smoothness of 22.28 and the thickness of 0.105 for the recording material P, the control calculation portion 10 discriminates the species of the recording material P as the recording material D on the basis of an obtained detection result and Table 1. With an increasing number of detected parameters, accuracy when the recording material P is identified is more improved. For this reason, for example, in this embodiment, the stiffness, the surface smoothness and the thickness of the recording material P are detected by the distance measuring sensor 40 and the sensor 60, and the recording material P is identified using these detected values on the basis of Table 1.

As described above, the control calculation portion 10 checks the pieces of information on the stiffness, the surface smoothness and the thickness of the recording material measured in the image forming apparatus against characteristic values in the list of the species of the recording materials as shown in Table 1, so that the control calculation portion 10 can identify the actually used recording material. However, the actually measured characteristic values are influenced by non-uniformity of the recording material, a lot difference, a variation in detection of a measuring device and the like, and thus exhibits a variation. In this embodiment, the pieces of information shown in the species list of Table 1 are an average of a plurality of measured values. The control calculation portion 10 regards the recording material, as a recording material used, having three characteristic values of the stiffness, the surface smoothness and the thickness which are measured in the image forming apparatus and all of which fall, e.g., ±10% of an associated average.

In order to further improve the accuracy of the identification of the recording material, it is desirable that also the measurement in the image forming apparatus is made over a plurality of the recording materials. In this embodiment, after setting of the recording materials in the sheet feeding cassettes 15A and the like is detected, for example, the measurement by the sensor 60 is made over 10 sheets, and an average of the measured values is obtained. Further, a constitution in which a variation in measurement is measured together with obtaining of the average and then whether or not the measured 10 sheets of the recording materials are those having the same species is discriminated may also be employed.

By employing such a constitution, similarly as in Embodiment 4, in a state in which the recording material to be normally used in the sheet feeding cassettes 15A and the like is registered, the recording material to be used is identified by the method described in Embodiment 4. On the other hand, in the case where the recording material registered in Table 1 is not used, the species of the unregistered recording material can be discriminated. In the case where the recording material (sheet) is discriminated as being changed such as pulling-out and insertion of the sheet feeding cassettes 15A and the like, the control calculation portion 10 identifies the recording material by checking the pieces of information obtained by the distance measuring sensor 40 and the sensor 60 against the list of Table 1. When the control calculation portion 10 identifies the recording material, the control calculation portion 10 can obtain an associated filler content of the recording material necessary to make the lifetime calculation, from the list of Table 1. The control calculation portion 10 obtains the correction efficiency P(Snew) from the stiffness measured by the distance measuring sensor 40 and the fixing content of the identified recording material P, by using the matrix of FIG. 6, so that the lifetime calculation with accuracy can be made.

[Manually Feeding Tray]

In Embodiment 4, based on the premise that the image forming apparatus is in the MPS environment in which the recording material to be used is restrictive, description is made on the assumption that "another recording material" is one species for each of the sheet feeding cassettes 15A and the like. However, in the case where a plurality of recording materials are used for the sheet feeding cassettes 15A and the like, there is also a liability that the recording materials are not listed in Table 1. In this embodiment, even in such a situation, when the recording material can be discriminated to some degree, it is possible to make the lifetime calculation with high accuracy by storing a use period for each of the recording materials. Particularly, when compared with the sheet feeding cassettes 15A-15C of a cassette type, there is a tendency that various recording materials are used in the manually feeding tray 15D. For this reason, as in this embodiment, it is desirable that the lifetime calculation is enabled based on the premise that many species of the recording materials are used. Further, also as regards the identification of the recording material, for the recording material fed from the manually feeding tray 15D, a constitution in which the identification is made on the basis of measurement for each sheet, not on the basis of the above-described average of 10 sheets, in order to meet the case where the recording material to be used is changed at a high frequency is employed.

An abrasion amount due to the recording material fed from the manually feeding tray 15D will be described. Here, as regards the manually feeding tray 15D, there are in species of recording materials listed inclusive of those listed in Table 1, and in addition thereto, n species of "another recording material" are fed. In that case, an integrated abrasion amount Wd by the recording material fed from the manually feeding tray 15D can be represented by a formula (6) below. Thus, the control calculation portion 10 acquires the integrated abrasion amount for each of the species of the recording materials placed on the manually feeding tray 15D and adds up the integrated abrasion amounts of the species, so that the integrated abrasion amount of the parting layer 211S is calculated.

$$\text{Integrated abrasion amount } Wd=\Sigma Wd_i+\Sigma(Wd_xj\times P(\text{Snew}_j)/P(Sxj))\ (i=1 \text{ to } m,\ j=1 \text{ to } n) \quad (6)$$

By employing such a constitution, even in the case where a period of feeding sheets of a single species of the recording material is divided into a plurality of sub-periods such that sheets of the same species of the recording material are placed while interposing another species of the recording material therebetween, there is no need to separately acquire associated integrated abrasion amounts W. That is, by acquiring the integrated abrasion amount for each of the species of the recording materials, an amount of stored information can be compressed.

In this embodiment, as shown in FIG. 10, the reflected light and the transmitted light are taken as images by the CMOS area sensor 63A, so that information on the surface unevenness of the recording material and the thickness information of the recording material are detected and detected results are used for identifying the species of the recording material. However, the recording material characteristic detecting means applicable to the present invention is not limited thereto, but may also has the following constitution, for example. For example, sensors of various types, such as an ultrasonic sensor for recognizing (detecting) the surface state, the thickness and the basis weight of the recording material by irradiating the recording material with ultrasonic waves and then by detecting a reflectance or a transmittance thereof may also be used singly or in combination.

Also the identifying method of the recording material to be used and the correction efficiency acquiring means are not limited to those described above, but may also be, e.g., those in which a degree of coincidence between the measured characteristic value and a closest characteristic of the recording material is reflected in the correction efficiency. Further, in this embodiment, the identification of the recording material is made on the basis of the stiffness, the thickness and the surface smoothness of the recording material. However, physical properties used for identifying the recording material are not limited thereto, but a constitution in which only the thickness and the surface smoothness of the recording material are used and the stiffness as a value measured in advance for each recording material is put on a list may also be employed. In either case, a characteristic value other than the characteristic value acquired by identifying the recording material is obtained by making reference to the list of Table 1 and then the lifetime calculation is made in this embodiment. On the other hand, as a result of the measurement, in the case where there is no corresponding recording material in the list of Table 1, the lifetime calculation is tentatively made using a predetermined value and the species and the characteristic value of the recording material are registered in the list, and thereafter the lifetime is calculated again. This constitution is similar to that in Embodiment 4.

As described above, according to this embodiment, even when the recording material is changed, it is possible to accurately estimate a degree of the lowering in performance of the feeding means depending on the recording material.

Embodiment 6

When the user sets characteristic values of many recording materials P for an individual image forming apparatus, there is a liability that usability lowers. Further, as described above, the data of the stiffness and the filler content of the recording material P are known by the management user of the image forming apparatus but cannot be known by the general user in some cases. In these cases, these parameters are set by the management user. However, in the case where the management user manages a plurality of image forming apparatuses and a plurality of recording materials P, for an individual image forming apparatus, the management user repetitively makes setting of the characteristic values of the same recording material many times. When such a setting operation can be performed at one time, an operation efficiency of the management user can be improved. Therefore, in this embodiment, a constitution in which registration of the species and the characteristic values of the recording material P are made from a host device via a network circuit is employed. Basic constituent elements are similar to those described in Embodiment 3 with reference to FIGS. 7A and 7B, and therefore are represented by the same reference numerals or symbols.

Figure 11A:
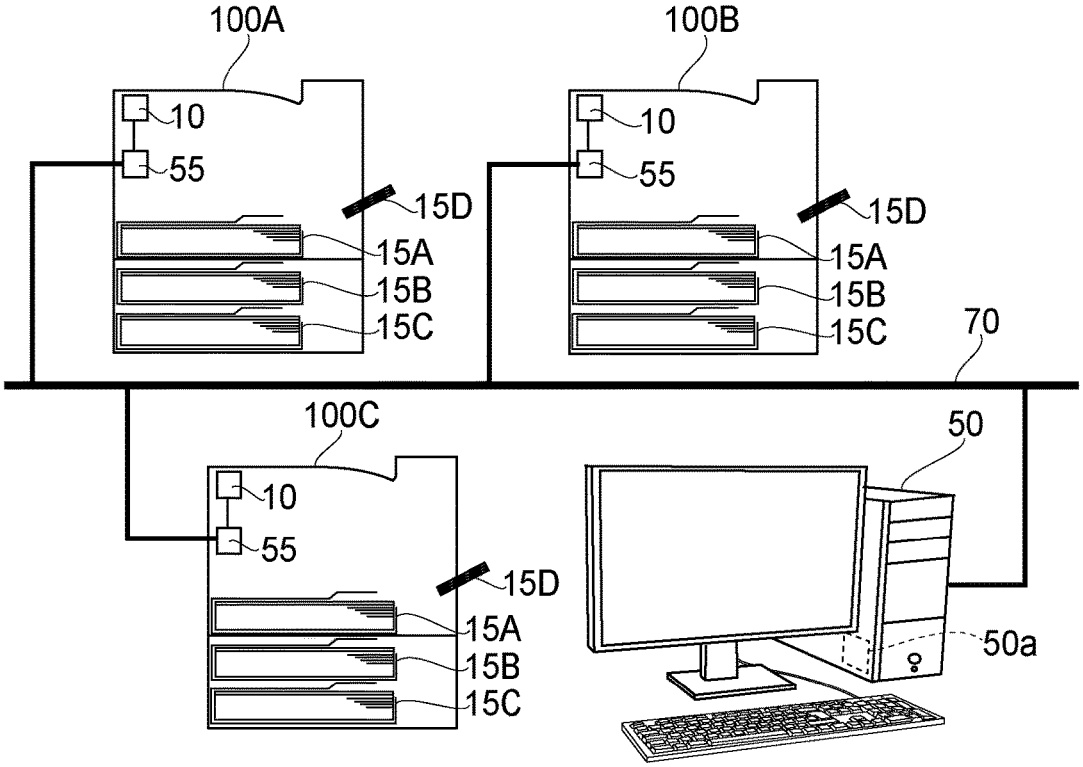
FIG. 11A is an illustration of a management system in Embodiment 6.

FIG. 11A is a schematic view showing a connection state of a plurality of image forming apparatuses 100A to 100C and a host device 50 in this embodiment. All of the image forming apparatuses 100A to 100C are connected with a network circuit 70 through associated network connecting devices 55. The host device 50 includes a controller 50*a* which is a setting means. The controller 50*a* of the host device 50 is capable of registering the characteristic values of the recording material P for each of the sheet feeding cassettes 15 of the image forming apparatuses 100A to 100C via the network circuit 70. In each of the image forming apparatuses 100A to 100C, the network connecting device 55 is connected with an associated control calculation portion 10, and the characteristic values of the recording material P inputted through the network circuit 70 are held (stored) in the control calculation portion 10 also functioning as a storing means. Constitutions and operations of the image forming apparatuses 100A to 100C are similar to those described in Embodiments 4 and 5, and similar constituent members or portions are represented by the same reference numerals or symbols and will be omitted from description.

The host device 50 is connected with the image forming apparatuses 100A to 100C through the same network circuit 70, so that the host device 50 is capable of effecting centralized control (management) of settings of the image forming apparatuses 100A to 100C and monitoring of an operation status. When the information such as the characteristic values of the recording material P is sent from the host device 50, for example, by using a management screen as shown in FIG. 11B, the host device 50 selects the image forming apparatus which is a destination.

Figure 11B:
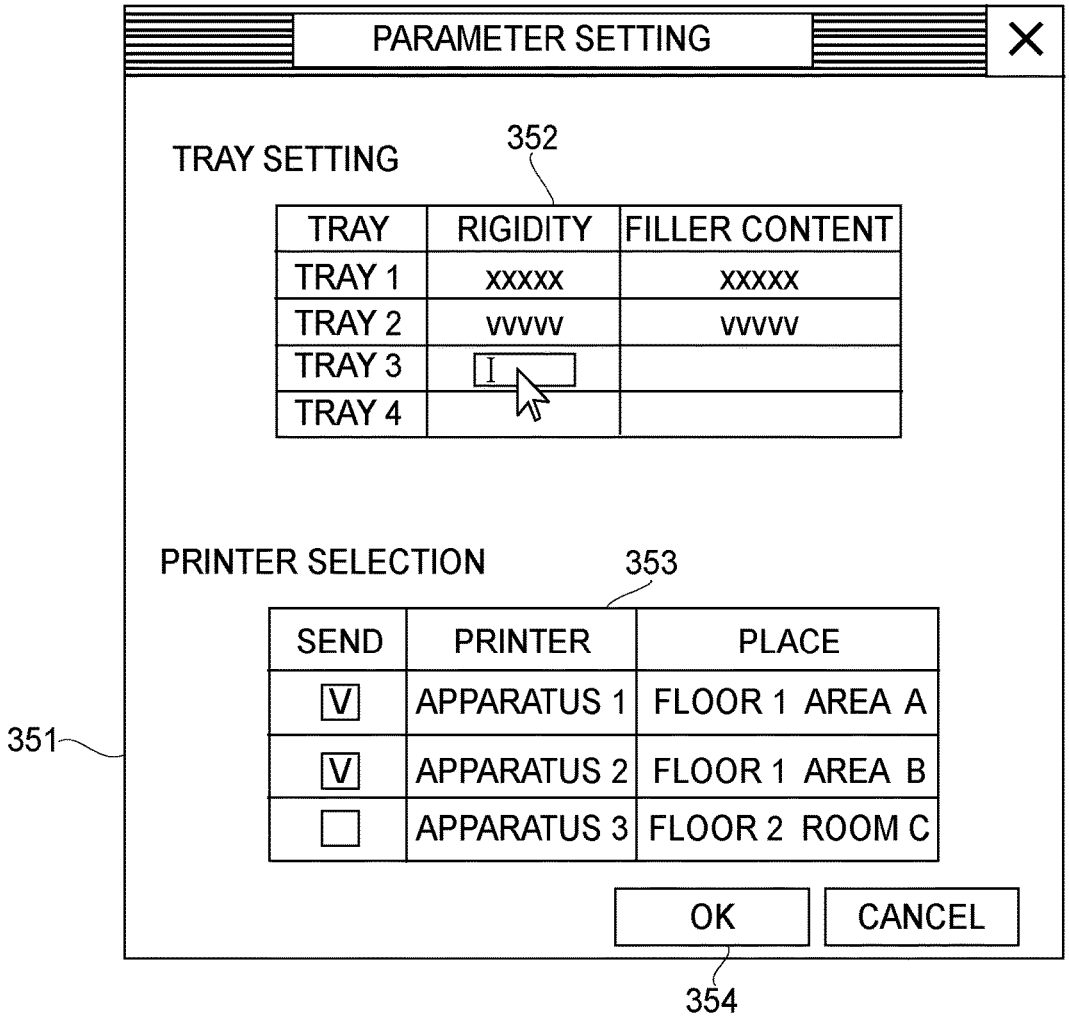
FIG. 11B is an illustration of a management screen in Embodiment 6.

FIG. 11B is a management screen 351 displayed on the host device 50. On the management screen 351, a "sheet parameter management setting menu ("PARAMETER SETTING")" is displayed, and data of a tray setting input portion 352 and a setting sending printer selection portion 353 can be inputted. At the tray setting input portion 352, data of the characteristic values such as the stiffness and the filler content of the recording material P set in each of trays 1 to 4 corresponding to the sheet feeding cassettes 15A and the like, respectively, can be registered. Further, at the setting sending printer selection portion 353, information on an installation place of each of image forming apparatuses 1 to 3 corresponding to the image forming apparatuses 100A to 100C, respectively, is displayed. At the setting sending printer selection portion 353, sending of the data of the characteristic values of the recording material P registered at the tray setting input portion to what image forming apparatus can be set by checking a check box.

For example, at the setting sending printer selection portion 353 shown in FIG. 11B, check boxes of the image forming apparatus 1 corresponding to the image forming apparatus 100A and the image forming apparatus 2 corresponding to the image forming apparatus 100B are checked. For this reason, the same characteristic values for the recording materials P set for the trays 1 to 3 of each of the image forming apparatuses 1 and 2 at the tray setting input portion 352 are registered. For this reason, the host device 50 functions as a setting means. After these data are inputted by the user, the controller 50*a* of the host device 50 sends these pieces of information to corresponding controllers 10 of the image forming apparatuses 100A to 100C by pressing down on OK button 354 by the user. As a result, the host device 50 can effect centralized control of the image forming apparatuses 100A to 100C. In this embodiment, the constitution in which the data of the stiffness and the filler content are registered as the characteristic values is employed, but a constitution in which the characteristic values are registered may only be required to be employed.

As individual discrimination (identification) information of the image forming apparatus, an IP address or the like registered for the image forming apparatus is used, and thus individual discrimination of the image forming apparatus can be made using a known method by the host device 50. In this manner, the host device 50 sends the characteristic values of the recording material P to the plurality of the image forming apparatuses selected through the management screen 351 for each of the sheet feeding cassettes 15 to at one time.

As described above, by using the characteristic values of the recording material P registered via the network circuit 70, the control calculation portion 10 of each of the image forming apparatuses can make the lifetime calculation of the fixing portion 21 with accuracy. Further, a result of the lifetime calculation made in each of the image forming apparatuses is sent to the host device 50 via the network circuit 70. As a result, the host device 50 can hold the lifetime calculation result of the fixing portion 21 of each of the image forming apparatuses as one of pieces of maintenance management information, so that the host device 50 can also alleviate a management load of the management user.

As described above, a management system of the image forming apparatus is constructed, so that the data of the characteristic values of the recording material can be registered by a one-time operation into the plurality of the image forming apparatuses, inclusive of the recording materials to be used, by a one-time operation. As a result, an operation load of the management user can be considerably reduced.

In the above-described embodiments, as an object to be subjected to the prediction calculation of the degree of deterioration, the heating film 211 was used, but the present invention is not limited thereto. For example, other than the heating film 211, the present invention may also be applied to the pressing roller 21*a* which is a part constituting the fixing portion 21. Further, only the prediction calculation value of the degree of deterioration of the heating film 211 is used in the lifetime calculation of the fixing portion 21, but the lifetime calculation may also be made in comprehensive consideration of the degree of deterioration and the like of the other parts constituting the fixing portion 21 as described above. Further, the present invention is also application to the feeding means in general, which contributes to the feeding of the recording material in contact with the surface of the recording material P, such as the secondary transfer roller 25 or the feeding rollers 17 and 18, other than the fixing portion 21.

As described above, according to this embodiment, depending on the recording material to be fed, the degree of the lowering in performance of the feeding means can be estimated with accuracy even when the recording material is changed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-213021 filed on Oct. 29, 2015, and 2015-213022 filed on Oct. 29, 2015, which are hereby incorporated by reference herein in their entirety.

What is claimed is:

1. An image forming apparatus comprising:

a feeding member for feeding a recording material; and an obtaining unit for obtaining a degree of deterioration of the feeding member depending on stiffness of the recording material, wherein the degree of deterioration of the feeding member obtained by said obtaining unit is larger with increasing stiffness of the recording material.

2. The image forming apparatus according to claim 1, further comprising a detecting unit for detecting the stiffness of the recording material, wherein the detecting unit detects a flection amount of a leading end portion of the recording material with respect to a vertical direction.

3. The image forming apparatus according to claim 1, wherein the feeding member is a fixing member for fixing a toner image on the recording material, wherein the fixing member includes a heating film and a pressing roller and feeds the recording material while nipping the recording material in a fixing nip formed by the heating film and the pressing roller.

4. The image forming apparatus according to claim 1, wherein the obtaining unit obtains the degree of deterioration of the feeding member depending on the stiffness of the recording material and a content of a filler contained in the recording material, wherein the degree of deterioration of the feeding member obtained by said obtaining unit is larger with an increasing content of the filler contained in the recording material.

5. The image forming apparatus according to claim 4, further comprising an inputting unit for inputting the stiffness of the recording material and the content of the filler contained in the recording material.

6. The image forming apparatus according to claim 4, wherein the obtaining unit acquires an abrasion amount, as the degree of deterioration, obtained by multiplying at least one of an abrasion amount per sheet and an abrasion amount per rotation when the recording material is fed by the feeding member by an efficiency depending on the stiffness and the content of the filler and then by integrating a resultant value.

7. The image forming apparatus according to claim 6, wherein the obtaining unit sets the efficiency at a smaller value with a smaller value of the stiffness and with a smaller content of the filler.

8. The image forming apparatus according to claim 4, further comprising a placing portion where the recording material is placed, wherein when the recording material placed on the placing portion is changed to a recording material different in species therefrom, the obtaining unit obtains the degree of deterioration of the feeding member from the degree of deterioration on the basis of a characteristic value of the recording material having species before the change and the degree of deterioration on the basis of a characteristic value of the recording material having species after the change.

9. The image forming apparatus according to claim 8, further comprising, a storing unit for storing the species of the recording materials and the characteristic values of the recording materials associated with the species of the recording materials, a display unit, a selecting unit for displaying a list of the species of the recording materials stored in the storing unit and for selecting the species of the recording material after the change from the list, and an identifying unit for identifying the species of the recording material after the change depending on a result of selection by the selecting unit.

10. The image forming apparatus according to claim 9, wherein when the species of the recording material identified by the identifying unit is stored in the storing unit, the obtaining unit acquires the characteristic value of the recording value material having species after the characteristic value from the storing unit and then obtains the degree of deterioration of the feeding member by using the acquired characteristic value of the recording material.

11. The image forming apparatus according to claim 9, wherein when the species of the recording material identified by the identifying unit is not stored in the storing unit, the obtaining unit obtains the degree of deterioration of b the feeding member by using the characteristic value of the recording material, of recording materials usable in the image forming apparatus, capable of providing a largest degree of deterioration of the feeding member, as a tentative characteristic value.

12. The image forming apparatus according to claim 11, further comprising a registering unit for registering species of the recording material which is not stored in the storing unit and a characteristic of the recording material which is not stored in the storing unit, wherein when the characteristic value of the recording material identified by the identifying unit is registered by the registering unit, the obtaining unit obtains again the degree of deterioration of the feeding member on the basis of the tentative characteristic value and the characteristic value registered by the registering unit.

13. The image forming apparatus according to claim 8, further comprising, a storing unit for storing the species of the recording materials and the characteristic values of the recording materials associated with the species of the recording materials, a detecting unit for detecting a characteristic value of a recording material fed, and an identifying unit for identifying the species of the recording material after the change on the basis of the characteristic value of the recording material detected by the detecting unit and the characteristic value of the recording material stored in the storing unit.

14. The image forming apparatus according to claim 13, wherein the detecting unit detects at least one of the stiffness of the recording material, surface smoothness of the recording material and a thickness of the recording material.

15. The image forming apparatus according to claim 8, further comprising a plurality of placing portions, wherein the obtaining unit obtains the degree of deterioration of the feeding member by obtaining values of the degree of deterioration of the feeding member for the placing portions and then by adding up the values of the degree of deterioration of the feeding member for the placing portions.

16. The image forming apparatus according to claim 4, wherein the filler contains at least one of calcium carbonate, silica, titanium oxide, talc and clay.

17. The image forming apparatus according to claim 1, wherein the obtaining unit calculates the degree of deterioration of the feeding member depending on the stiffness of the recording material.

18. The image forming apparatus according to claim 1, wherein the obtaining unit obtains a lifetime of the feeding member on the basis of the obtained degree of deterioration.

19. A management system comprising:

a plurality of image forming apparatuses; and a management apparatus connected with the image forming apparatuses via a network circuit, wherein each of the image forming apparatuses includes, a plurality of placing portions where a recording material is placed, a feeding member for feeding the recording material, and an obtaining unit for obtaining a degree of deterioration of the feeding member, wherein the management apparatus includes, a setting unit capable of making batch setting, for each of the placing portions, of values of stiffness of recording materials placed on the placing portions of the image forming apparatuses, wherein the obtaining unit obtains the degree of deterioration on the basis of the stiffness of the recording material which is set by the setting unit and then obtains a lifetime of the feeding member on the basis of the obtained degree of deterioration, and wherein the degree of deterioration of the feeding member obtained by said obtaining unit is larger with increasing stiffness of the recording material.

20. The management system according to claim 19, wherein the obtaining unit obtains the degree of deterioration of the feeding member by obtaining values of the degree of deterioration of the feeding member for the placing portions and then by adding up the values of the degree of deterioration of the feeding member for the placing portions.

21. The management system according to claim 19, wherein the feeding member is a fixing member for fixing a toner image on the recording material, wherein the fixing member includes a heating film and a pressing roller and feeds the recording material while nipping the recording material in a fixing nip formed by the heating film and the pressing roller.

22. The management system according to claim 19, wherein the setting unit is capable of making batch setting, for each of the placing portions, of the values of stiffness of recording materials placed on the placing portions of the image forming apparatuses and contents of fillers contained in the recording materials, wherein the obtaining unit obtains the degree of deterioration on the basis of the stiffness of the recording material and the content of the filler which are set by the setting unit and then obtains the lifetime of the feeding member on the basis of the obtained degree of deterioration, and wherein the degree of deterioration of the feeding member obtained by said obtaining unit is larger with an increasing content of the filler contained in the recording material.

23. The management system according to claim 22, wherein the obtaining unit acquires an abrasion amount, as the degree of deterioration, obtained by multiplying at least one of an abrasion amount per sheet and an abrasion amount per rotation when the recording material is fed by the feeding member by an efficiency depending on the stiffness and the content of the filler and then by integrating a resultant value.

24. The management system according to claim 23, wherein the obtaining unit sets the efficiency at a smaller value with a smaller value of the stiffness and with a smaller content of the filler.

25. The management system according to claim 22, wherein when the recording material placed on any one of the placing portions is changed to a recording material different in species therefrom, the obtaining unit obtains the degree of deterioration of the feeding member from the degree of deterioration on the basis of a characteristic value of the recording material having species before the change and the degree of deterioration on the basis of a characteristic value of the recording material having species after the change.

26. The management system according to claim 25, wherein each of the image forming apparatuses further includes, a storing unit for storing the species of the recording materials and the characteristic values of the recording materials associated with the species of the recording materials, a display unit, a selecting unit for displaying a list of the species of the recording materials stored in the storing unit and for selecting the species of the recording material after the change from the list, and an identifying unit for identifying the species of the recording material after the change depending on a result of selection by the selecting unit.

27. The management system according to claim 26, wherein when the species of the recording material identified by the identifying unit is not stored in the storing unit, the obtaining unit obtains the degree of deterioration of the b feeding member by using the characteristic value of the recording material, of recording materials usable in the image forming apparatus, capable of providing a largest degree of deterioration of the feeding member, as a tentative characteristic value.

28. The management system according to claim 27, wherein when the characteristic value of the recording material identified by the identifying unit is registered by the setting unit, the obtaining unit obtains again the degree of deterioration of the feeding member on the basis of the tentative characteristic value and the characteristic value registered by the setting unit.

29. The management system according to claim 22, wherein the filler contains at least one of calcium carbonate, silica, titanium oxide, talc and clay.

30. The management system according to claim 19, wherein the obtaining unit calculates the degree of deterioration of the feeding member depending on the stiffness of the recording material.

* * * * *